US008360680B2

(12) United States Patent
Allen et al.

(10) Patent No.: US 8,360,680 B2
(45) **Date of Patent: *Jan. 29, 2013**

(54) HYDRAULIC RIDING TROWELS WITH AUTOMATIC LOAD SENSING

(75) Inventors: J. Dewayne Allen, Paragould, AR (US); Timmy D. Guinn, Paragould, AR (US); Edward A. Waldon, Paragould, AR (US); Scott R. Sugg, Paragould, AR (US)

(73) Assignee: Allen Engineering Corporation, Paragould, AR (US)

( * ) Notice: Subject to any disclaimer, the term of this patent is extended or adjusted under 35 U.S.C. 154(b) by 293 days.

This patent is subject to a terminal disclaimer.

(21) Appl. No.: 12/661,007

(22) Filed: Mar. 9, 2010

(65) Prior Publication Data

US 2011/0222966 A1 Sep. 15, 2011

(51) Int. Cl.
*E01C 19/22* (2006.01)

(52) U.S. Cl. ..... 404/112

(58) Field of Classification Search ..... 404/112
See application file for complete search history.

(56) References Cited

U.S. PATENT DOCUMENTS

| | | | |
|---|---|---|---|
| 2,898,826 | A | 4/1956 | Livermont |
| 2,869,442 | A | 1/1959 | Mincher |
| 3,412,657 | A | 11/1968 | Colizza |
| 3,554,291 | A | 1/1971 | Rogers |
| 3,564,986 | A | 2/1971 | Burgin |
| 3,936,212 | A | 2/1976 | Holz, Sr. |
| 3,973,857 | A | 8/1976 | Whiteman, Jr. |
| 4,027,991 | A | 6/1977 | Maas |
| 4,046,484 | A | 9/1977 | Holz, Sr. |
| 4,232,980 | A | 11/1980 | Tertinek |
| 4,249,327 | A | 2/1981 | Allen |
| 4,312,603 | A | 1/1982 | Whiteman, Jr. |
| 4,314,773 | A | 2/1982 | Allen |
| 4,316,715 | A | 2/1982 | Allen |
| 4,320,986 | A | 3/1982 | Morrison |
| 4,349,294 | A | 9/1982 | Allen |
| 4,349,328 | A | 9/1982 | Allen |
| 4,363,618 | A | 12/1982 | Allen |
| 4,375,351 | A | 3/1983 | Allen |
| 4,412,803 | A | 11/1983 | Allen |
| 4,466,757 | A | 8/1984 | Allen |
| 4,540,312 | A | 9/1985 | Allen |
| 4,544,346 | A | 10/1985 | Allen |
| 4,572,704 | A | 2/1986 | Allen |
| 4,577,993 | A | 3/1986 | Allen |

(Continued)

FOREIGN PATENT DOCUMENTS

DE 94 18 169.1 1/1995

*Primary Examiner* — Thomas B Will
*Assistant Examiner* — Abigail A Risic
(74) *Attorney, Agent, or Firm* — Stephen D. Carver

(57) ABSTRACT

High performance, multiple rotor, hydraulically driven riding trowels for finishing concrete have unloader valve circuitry for controlling hydraulic pressure. Each trowel has a rigid frame with two or more downwardly-projecting, bladed rotor assemblies that finish concrete. The rotor assemblies are tilted manually or hydraulically to effectuate steering and control. Blade pitch is controlled manually or hydraulically. The unloader valve system monitors drive pump pressure with a shuttle valve to derive an unloader pilot signal. A sequence valve responds to the unloader pilot signal to control a pressure valve that bypasses the normal foot control valve in an overpressure situation. The pressure control head signal normally applied to the hydraulic drive motor control heads is modified with a feedback signal to automatically control the associated pump swash plates. A gearbox may be disposed between the drive motors and rotors. Piston type and gear and vane type motors may power the rotors.

19 Claims, 19 Drawing Sheets

U.S. PATENT DOCUMENTS

| | | | |
|---|---|---|---|
| 4,629,359 | A | 12/1986 | Sengupta |
| 4,630,964 | A | 12/1986 | Allen |
| 4,659,054 | A | 4/1987 | Allen |
| 4,673,311 | A | 6/1987 | Whiteman, Jr. |
| 4,676,690 | A | 6/1987 | Allen |
| 4,676,691 | A | 6/1987 | Morrison |
| 4,685,826 | A | 8/1987 | Allen |
| 4,697,951 | A | 10/1987 | Allen |
| 4,702,640 | A | 10/1987 | Allen |
| 4,710,054 | A | 12/1987 | Allen |
| 4,710,055 | A | 12/1987 | Maass |
| 4,741,643 | A | 5/1988 | Allen |
| 4,775,306 | A | 10/1988 | Kikuchi |
| 4,784,519 | A | 11/1988 | Artzberger |
| 4,798,494 | A | 1/1989 | Allen |
| 4,859,114 | A | 8/1989 | Artzberger |
| 4,977,928 | A | 12/1990 | Smith et al. |
| D323,510 | S | 1/1992 | Allen |
| 5,108,220 | A | 4/1992 | Allen |
| 5,190,401 | A | 3/1993 | Wilson |
| 5,238,323 | A | 8/1993 | Allen |
| D340,340 | S | 10/1993 | Allen |
| 5,281,050 | A | 1/1994 | Howard |
| 5,288,166 | A | 2/1994 | Allen |
| D344,736 | S | 3/1994 | Allen |
| 5,328,295 | A | 7/1994 | Allen |
| 5,352,063 | A | 10/1994 | Allen |
| 5,405,216 | A | 4/1995 | Allen |
| 5,480,257 | A | 1/1996 | Allen |
| 5,480,258 | A | 1/1996 | Allen |
| 5,533,831 | A | 7/1996 | Allen |
| 5,562,361 | A | 10/1996 | Allen |
| 5,613,801 | A | 3/1997 | Allen |
| 5,685,667 | A | 11/1997 | Allen |
| 5,816,739 | A | 10/1998 | Allen |
| 5,816,740 | A | 10/1998 | Jaszkowiak |
| D404,042 | S | 1/1999 | Allen |
| 5,890,833 | A | 4/1999 | Allen |
| 5,934,823 | A | 8/1999 | Allen |
| 5,967,696 | A | 10/1999 | Allen |
| 5,988,938 | A | 11/1999 | Allen |
| 6,019,433 | A | 2/2000 | Allen |
| 6,019,545 | A | 2/2000 | Allen |
| 6,048,130 | A | 4/2000 | Allen |
| 6,053,660 | A | 4/2000 | Allen |
| 6,089,786 | A | 7/2000 | Allen |
| 6,089,787 | A | 7/2000 | Allen |
| 6,106,193 | A | 8/2000 | Allen |
| D466,909 | S | 12/2002 | Allen |
| 6,582,153 | B1 | 6/2003 | Allen |
| 6,695,532 | B2 | 2/2004 | Somero |
| 6,758,631 | B2 | 7/2004 | Frankeny, II |
| 6,857,815 | B2 | 2/2005 | Allen |
| 6,988,851 | B2 | 1/2006 | Sina |
| 7,108,449 | B1 | 9/2006 | Allen |
| 7,114,876 | B1 | 10/2006 | Allen |
| 7,201,537 | B2 | 4/2007 | Sina |
| 7,204,659 | B2 | 4/2007 | Schmitt |
| 7,316,523 | B1 | 1/2008 | Allen |

Fig. 1

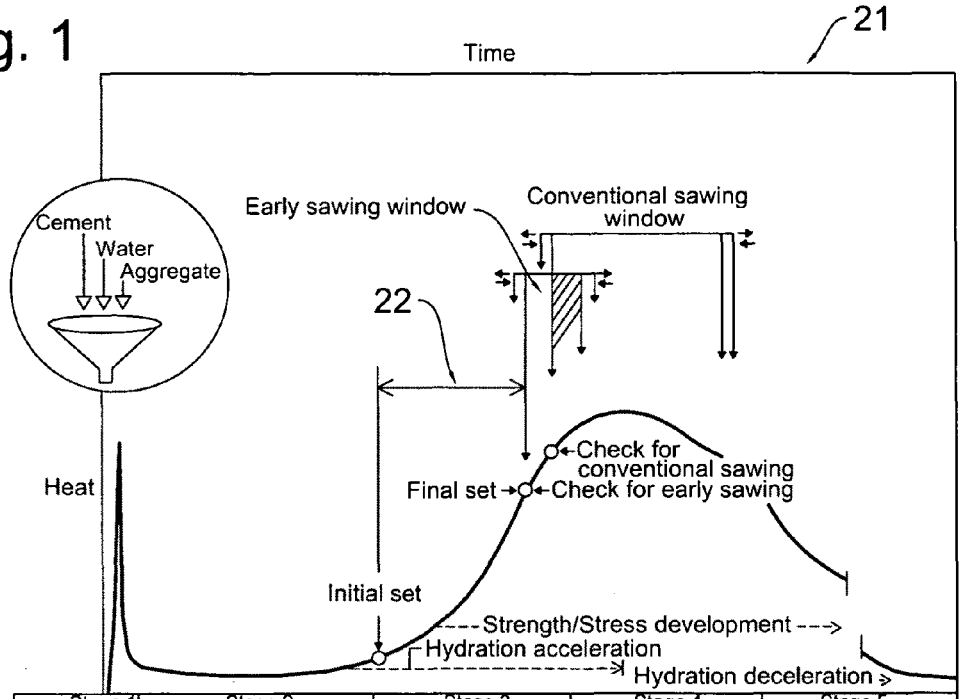

| | Stage 1 | Stage 2 | Stage 3 | Stage 4 | Stage 5 |
|---|---|---|---|---|---|
| | Mixing | Dormancy | Hardening | Cooling | Densification |
| | Lasts about 15 minutes | Lasts about 2-4 hours | Lasts about 2-4 hours | | Continues for years |
| Characteristics of concrete mixture | Hight heat is generated immediately, followed by rapid cooling. | Mixture is plastic, workable, and not generating significant heat. | • Hydration generates significant heat.<br>• Mixture sets, begins to harden, and gains strength<br>• Stress begins developing in the concrete. | Stress development will exceed strength development if stress is not relieved. | Slab continues to become stronger and less permeable. |
| What engineers, supervisors, and workers must do to ensure durable pavement | Ensure adequate mixing. | Transport, place, and finish the concrete while plastic and workable. | • Begin curing as soon as possible.<br>• Thoroughly apply curing compound. | Saw joints to relieve stress and control cracking. | • Insulate the slab if air temperature is expected to cool rapidly and significantly.<br>• Protect curing compound as long as possible. |

PRIOR ART

HYDRAULIC RIDING TROWELS WITH AUTOMATIC LOAD SENSING

CROSS-REFERENCE TO RELATED APPLICATIONS

This utility patent application is based upon, and claims the filing date of, a prior pending utility application entitled "Hydraulic Riding Trowel with Automatic Load Sensing System," Ser. No. 12/317,422, filed Dec. 22, 2008, which was in turn based upon a provisional application entitled "Hydraulic Riding Trowel with Motor Control. Hydraulic Feedback," Ser. No. 61/009,182, was filed Dec. 27, 2007.

BACKGROUND OF THE INVENTION

I. Field of the Invention

The present invention relates generally to hydraulically-driven, multiple rotor riding trowels with either hydraulic or manual steering, and with hydraulic control circuits used in such trowels. More particularly, the present invention relates to hydraulically-driven riding trowels using hydraulic circuitry including an unloader circuit responsive to hydraulic feedback for critically regulating the pump output flow to operate within the engine horsepower envelope. Riding trowels of this general type are classified in United States Patent Class 404, Subclass 112.

II. Description of the Prior Art

High power, multiple rotor, hydraulic riding trowels for finishing concrete are well recognized by those skilled in the art. Proper finishing insures that desired surface characteristics including appropriate smoothness and flatness are achieved. It is also important that delamination be minimized. High power, hydraulically driven riding trowels are capable of finishing large areas of plastic concrete quickly and efficiently, while insuring high quality surface characteristics.

Modern hydraulic power riding trowels comprise two or more bladed rotors that project downwardly and frictionally contact the concrete surface. In advanced machines the rotors are driven by hydraulic drive motors pressured by hydraulic pumps that are in turn powered by at least one internal combustion engine. The riding trowel operator sits on top of the frame and controls trowel movement with a steering system that tilts the rotors for control. The weight of the trowel and the operator is transmitted frictionally to the concrete by the revolving blades or pans. Frictional forces caused by rotor tilting enable the trowel to be steered.

Holz, in U.S. Pat. No. 4,046,484 shows a pioneer, twin rotor, self propelled riding trowel. U.S. Pat. No. 3,936,212, also issued to Holz, shows a three rotor riding trowel powered by a single motor. Although the designs depicted in the latter two Holz patents were pioneers in the riding trowel arts, the devices were difficult to steer and control.

Prior U.S. Pat. No. 5,108,220 owned by Allen Engineering Corporation, the same assignee as in this case, relates to a manual steering system for riding trowels that may be used with the instant invention. Motors-driven gearboxes were used for rotor propulsion.

Allen Engineering Corporation Pat. No. 5,613,801 issued Mar. 25, 1997 discloses a power riding trowel equipped with twin motors. The latter design employs a separate motor to power each rotor. Steering is accomplished with structure similar to that depicted in U.S. Pat. No. 5,108,220 previously discussed.

Older manually operated trowels used hand levers to develop rotor tilting movements for steering. Rotors were driven by internal combustion motors transmitting force through rotor gear boxes. Manually operated systems with gearbox-driven rotors have been largely replaced with hydraulic trowels. For example, U.S. Pat. No. 5,890,833 entitled "Hydraulically controlled Riding Trowel" issued to Allen Engineering Corporation on Apr. 6, 1999 discloses a high performance, hydraulic riding trowel using a joystick system that controls steering, propulsion, and blade pitch. A rigid trowel frame mounts two or more downwardly-projecting, bladed rotor assemblies that frictionally engage the concrete surface. The rotor assemblies are tilted with double acting hydraulic cylinders to effectuate steering and control. Double acting hydraulic cylinders also control blade pitch. The joystick system activates solenoid control valves that energize various hydraulic cylinders that tilt the rotors and alter blade pitch.

U.S. Pat. No. 6,089,786 entitled "Dual rotor riding trowel with proportional electro-Hydraulic Steering" issued Jul. 18, 2000 and U.S. Pat. No. 6,053,660 issued Apr. 25, 2000 and entitled "Hydraulically controlled twin rotor riding trowel" disclose joystick-operated, twin rotor riding trowels for finishing concrete. The trowel frame mounts two spaced-apart, downwardly projecting, and bladed rotors that frictionally contact the concrete surface. The rotors are tilted with double acting, hydraulic cylinders for steering and control. Double acting hydraulic cylinders also control blade pitch. A joystick system enables the operator to hand control the trowel with minimal physical exertion. The joystick system directly controls electrical circuitry that outputs proportional control signals to electrically control the steering or tilting cylinders. The hydraulic circuitry comprises a motor driven pump delivering pressure to a flow divider circuit.

U.S. Pat. No. 6,048,130 issued Apr. 11, 2000 and entitled "Hydraulically driven, multiple rotor riding trowel" and U.S. Pat. No. 5,816,739 entitled "High performance triple rotor riding trowel" disclose related, triple rotor hydraulic trowels.

U.S. Pat. No. 6,106,193 entitled "Hydraulically driven, Multiple Rotor riding trowel issued Aug. 22, 2000 discloses high performance, hydraulic riding trowels for finishing concrete. Separate hydraulic motors revolve each rotor assembly. Associated hydraulic circuitry engenders convenient joystick control.

U.S. Pat. No. 6,857,815 entitled "Acoustic impedance matched concrete finishing" issued Feb. 22, 2005 discloses a method for matching the acoustic impedance of concrete treating equipment to the acoustic impedance of the concrete slab being treated. A twin rotor riding trowel is provided with a pair of circular finishing pans that are attached to conventional rotor blades. The pans are characterized by an acoustic impedance approximating the acoustic impedance of plastic concrete, thereby optimizing the energy transferred to the concrete. The matching material comprises ultra high molecular weight polyethylene (UHMWPE) plastic. During troweling, the pans are frictionally revolved over the plastic concrete for finishing the surface without prematurely sealing the uppermost slab surface, to produce a highly stable concrete surface with minimal delamination.

U.S. Pat. No. 7,108,449 entitled "Method and apparatus for acoustically matched slip form Concrete Application" issued Sep. 19, 2006 involves the concept of acoustic matching discussed in Allen U.S. Pat. No. 6,857,815 and employs it with slip form pavers.

U.S. Pat. No. 7,114,876 entitled "Acoustically matched concrete finishing pans" issued Oct. 3, 2006 to Allen Engineering Corporation discloses improved acoustically matched pans for riding trowels. The pans are provided with means for matching the acoustic impedance of the concrete slab being treated as discussed in Allen U.S. Pat. No. 6,857,815.

German Pat. No. G9,418,169.1 entitled "Concrete smoothing machine" issued Jan. 26, 1995 to Betontechnik Shumacher GmbH discloses another hydraulic riding trowel of interest.

U.S. Pat. No. 5,816,740 entitled "Hydraulically controlled steering for power trowel" issued Oct. 6, 1998 to Timothy S. Jaszkowiak discloses dual-acting hydraulic cylinders interconnected to the rotors and the frame for steering.

U.S. Pat. No. 6,048,130 entitled "Hydraulically driven, multiple rotor riding trowel" issued Apr. 11, 2000 to Allen Engineering Corporation discloses a hydraulically-propelled, multiple rotor riding trowel utilizing hydraulic motors and circuitry.

U.S. Pat. No. 2,869,442 entitled "Floating and troweling machine" issued Nov. 29, 1956 to John M. Mincher discloses a floating and troweling machine for finishing plastic floors which is constructed so that it can controlled by an operator seated on the machine.

U.S. Pat. No. 4,320,986 entitled "Motor powered rotary trowel" issued Mar. 23, 1982 to Donald R. Morrison discloses a trowel with radially arranged trowel blades which can be adjustably tilted on their support arms in either direction and are mounted on a drive shaft which can be driven in either direction.

U.S. Pat. No. 4,676,691 entitled "Dual rotary trowel" issued Jun. 30, 1987 to Donald R. Morrison discloses a concrete troweling machine having two sets of troweling blades with a mechanism for setting the tilt of individual blades in a rotor assembly.

U.S. Pat. No. 4,977,928 entitled "Load sensing hydraulic system" issued Dec. 18, 1990 to Caterpillar Inc. discloses a hydraulic load sensing system and more particularly a hydraulic system in which one of the pressure compensated flow control valves is rendered inoperative during certain operating conditions of the system.

Barikell located in Australia has two versions of a hydraulic controlled riding trowel. The "MK8-120 HCS" and the "OL-120 HCS Overlapper" are the trowels noted. (http://www.barikell.com.au/)

Tremix located in Sweden has a hydraulic controlled riding trowel called the "Pro Rider" in which the machine is controlled by two joysticks that act directly upon the guiding valves. There are two foot pedals, one adjusting the revolutions of the engine, the other opening/closing the valves to the hydraulic engines. (http://www.tremix.com/eng/concrete/prorider.html)

An article found on an interne web page entitled "Insider secrets to Hydraulics" reveals how to understand hydraulic load sensing control in control circuits. (http://www.insidersecretstohydraulics.com/hydraulic-load-sensing.html)

MBW Inc. whose headquarters are in Slinger, Wis. U.S.A. has a riding trowel called the "MK8 121" in which the machine is controlled by two hydraulic joysticks.

Multiquip Inc. whose headquarters are in Carson, Calif. U.S.A. has two riding trowels that are hydraulically controlled and driven. The STX-55Y-6 and the HTX-44K-5 models are detailed in a MQ-WRPT-1797 Rev. H (01-08) brochure entitled "Ride-on Power Trowels".

An article in a January 2005 issue of Concrete Construction Magazine written by Ted Worthington describes a riding trowel called the "Tarantula." It is manufactured by a company called Full-Track BVBA located in Belgium. (http://www.concreteconstruction.net/industry-news.asp?sectionID=707&articleID=566833)

Bosch Rexroth Corporation has a product they manufacture entitled the "Power Valve" which is used to control a variable displacement pump's operating pressure. This item is detailed in a September 1999 brochure RE 95 514/09.99 distributed by Rexroth.

Bondioli and Pavesi Inc. has a product they manufacture entitled the "Power limiter control valve" and is used to maintain maximum power from a power source by sensing operating pressure of the hydraulic circuit. This item is detailed in a quick reference hydraulic catalog provided by Bondioli and Pavesi entitled "QH008".

Sauer Danfoss has a product they manufacture entitled the "MCV106A Hydraulic Displacement Control (HDC)." It uses mechanical feedback to establish closed-loop control of the swashplate angle of various pumps provided by Sauer Danfoss. This control is explained in article BLN-95-8972-3 issued March 1991 by Sauer Danfoss.

Notwithstanding numerous attempts at maximizing the speed of troweling, along with the pursuit of high quality concrete finishes, new problems have developed in the art.

Speed increases in surface finishing have made it possible for larger quantities of concrete to be placed in a given job environment in a given time. Modern placement speeds exceed the speed at which concrete was placed several years ago. Contractors routinely expect to finish thousands of square feet of surface area after placement. Panning and troweling stages commence when the concrete is still plastic.

Concrete undergoes numerous well recognized changes in its physical chemistry between the initial mixing stages and the final hardening stages. For example, as diagrammed in FIG. 1 below, in the initial mixing stage, high heat is generated followed by rapid cooling. This initial stage lasts about fifteen minutes, and it is critical that the mixture be adequately mixed. During the ensuing dormancy period, which lasts about two to four hours, the concrete mixture is plastic and workable, and high heat is no longer generated. At the beginning of the dormancy period, the plastic concrete is typically confined within a delivery vehicle during transportation to the job site. After transportation, delivery, and placement, various diverse finishing techniques follow. As concrete is laid, it can be struck off for initial shaping. Typically, screeding follows. At this time significant moisture may rise to the surface.

The subsequent hardening or hydration stage, which generates significant heat, lasts about two to four hours. The mixture sets, begins to harden, and the slab gains strength. Panning ideally starts at the "initial set" point indicated in FIG. 1, which is approximately between the dormancy and cooling stages. Large, circular metal pans are temporarily secured to the trowel rotors for panning. Alternatively, plastic pans, or acoustically matched pans, can be used. As the concrete hardens, pans are removed and blade troweling finishes the job. Often, multiple trowels, equipped with different pans or blades, are employed in stages.

After panning, when the concrete has gotten harder, blade troweling follows. Vigorous blade troweling continues through the hardening period. In the following cooling stage, stresses are developed within the slab, and stress relief, typically relieved by sawing, is required.

However, in typical construction, as large areas of concrete are poured and finished, wet, freshly poured concrete regions will often border harder regions. Large riding trowels rapidly traverse large areas of fresh concrete surface, and it is not uncommon for their spaced-apart rotors to simultaneously contact surface regions of varying hardness and frictional characteristics. Severe, potentially damaging stresses on the trowel drive train can result.

Further, when a trowel enters a plastic region of wet concrete characterized by a high friction, as can happen when panning stages encounter wet concrete too early, the severe power drain significantly slows the internal combustion engine powering the trowel. The same thing can happen when a trowel encounters concrete that is too plastic during blade troweling of a large, curing slab. When the rotors are overloaded, even if momentarily, engine droop can occur, stalling follows, and normal engine output drops. Internal combustion engines are particularly vulnerable to stalling and power drops in such circumstances. With hydraulic trowels, this sudden power drop reduces the hydraulic operating pressure below optimum levels, affecting trowel steering and control. Sometimes the sudden fluctuation in operating pressure, particularly if the engine stalls completely, can result in surface damage to the concrete from irregular rotor movements.

As a practical matter, stalling can occur when the required horsepower from the engine in a given situation exceeds the maximum horsepower available. Normally with hydraulic riding trowels it is desirable to maintain drive engine RPM within a relatively limited range at a favorable operating point. Sudden demands placed on the engine by the hydraulic system can place too much demand on the drive engine. Such condition causes reduced engine life, degraded trowel performance, overheating, and a reduction of finish quality. The horsepower required is a function of rpm and rotor torque. To optimize trowel operation, as rotor torque increases, rotor rpm can then be reduced to promote operation within the desired engine horsepower limits. When rotor load conditions occur where maximum rotor torque and maximum rotor rpm are required simultaneously, the corresponding engine horsepower availability may be inadequate.

In a typical hydraulic riding trowel an internal combustion engine drives one or more hydraulic pumps. The typical hydrostatic piston pump in a twin-rotor trowel drives two hydraulic rotor motors. A mechanical stroking device, including a mechanical arm that pivots a swash plate, can increase or decrease rotor rpm. Two mechanical arms connected by a common linkage are linked to a foot pedal controlled by an operator. When the foot pedal is depressed, the linkage creates a turning torque to the swash plates on both pumps. Resulting increased pump displacement creates increased flow to turn the rotor motors at an increased rpm. The stroking mechanism forces are dictated by piston pump pressure. As pressure increases, the holding torque needed to maintain position increases. This is a natural condition for a direct, mechanically operated stroking operation for a piston pump swash plate. To maintain swash plate position, and therefore rotor speed, the trowel operator takes corrective action by pushing harder on the foot-pedal. A rider's instinctive action is to further push the trowel foot pedal, which can stall the engine, with the consequences, discussed above.

Thus a solution is required to prevent riding trowel internal combustion engines from overloading and over-stressing in response to diverse RPM and torque requirements encountered upon varying concrete surfaces.

In using hydraulically driven riding trowels in the field, a problem with internal combustion engine overload was discovered. Severe overloading stresses the hydraulic components. One way to overcome the overloading problem is to increase pressure in the hydraulic system. The latter approach results in two problems however: not enough torque to the rotors, and failure of the machine to perform at higher engine RPM and torque without stalling. The torque required to turn the rotors is directly proportional to the weight of the machine. By using the operating parameters of the hydraulic riding trowel, torque requirements to finish the concrete can be measured. With less required torque, frictional forces, which can be measured in terms of coefficient of friction values, are less. During the window of finishability (i.e., FIG. 1), two occurrences of peak load occur, each during the pan and blade operations. At one point during the panning operation the surface exhibits a coefficient of friction that is larger than usual. At this time the invention is very useful to moderate this condition of heavy loading. Similarly during blade operations, this peak occurs at a point of finishing the concrete. Only at these moments of peak loading is there a spike in the demand of horsepower. This condition is somewhat unpredictable due to the different mixture content of the concrete and environmental conditions. Only in very large pours with rapid concrete placement can this be observed with any regularity. Most of the time this is elusive to observe in a small pour. It does occur in spots, however, and this will be very detrimental to efficient work using a smaller powered riding trowel. Space and weight limitations prevent using higher horsepower engines.

Thus there is a need to increase torque and reduce weight. A partial solution is to increase the displacement on the rotor motors, which increases torque and reduces RPM. It has been determined that the torque envelope required for proper operation sacrifices rotor RPM and internal combustion drive engine RPM. A solution could not be achieved with the existing system. The goal was to provide a system that could not be burdened by the operator and which would optimize performance levels of torque and rotor RPM without engine overload.

The instant system allows control of flow from the pump to the rotor motors based upon operating pressure. This controls the total horsepower required by the machine. When the set torque limit is obtained, rotor RPM is reduced to stay within the available engine horsepower. In a light load situation, there low torque and high RPM conditions result. Heavy load situations, are characterized by high torque and lower RPM.

Thus it is proposed to monitor hydraulic system conditions, and to derive a corrective hydraulic feedback signal, for various hydraulically driven trowels using either hydraulic steering or manual steering. A responsive unloading valve system is proposed to decrease rotor RPM at a maximum preselected torque limit and to increase rotor speed at a minimum predetermined torque limit. Simultaneously, it is important that the internal combustion engine operate within the optimum engine horsepower curve. Engine stalling is reduced, if not avoided altogether, notwithstanding the continually fluctuating surface frictional characteristics as depicted by the hydration curve (FIG. 1) of the concrete regions being traversed by the trowel.

SUMMARY OF THE INVENTION

This invention provides improved, high power, hydraulically-driven riding trowels equipped with a hydraulic unloader valve system for controlling the hydraulic pump or pumps driving the rotor drive motors. A hydraulic feedback circuit responsive to sensed pressures facilitates automatic control. The system may be employed with hydraulically powered trowels of the type using either manual or hydraulic steering.

In the best mode each rotor has a separate hydraulic drive motor and a corresponding hydraulic pump for supplying operating fluid flow and pressure. An auxiliary pump supplies fluid pressure for accessory operation, including the foot-pedal that controls the rotor hydraulic pumps. The feedback system includes an unloader valve arrangement that senses potential over-pressure conditions in the rotor drive motors. A shuttle valve determines when either of the hydraulic rotor motors is pressured excessively. A sequence valve driven by the shuttle valve controls a diverter valve that dynamically triggers a pressure adjustment.

In operation the unloader valve circuit bypasses the normal foot-pedal control to instantly dethrottle the hydraulic drive motors by adjusting the swash plates within the hydraulic drive pumps. Reduced flow is then experienced by the rotor drive motors, and consequently reduced rotor rpm occurs, minimizing surface damage and maintaining optimum drive-engine horsepower.

Thus a basic object of our invention is to provide a system that dynamically controls riding trowel hydraulic drive pumps in response to the load conditions being experienced by the rotors.

A related object is to moderate the demands of the hydraulic system on the trowel's internal combustion engine.

A similar object is to provide a trowel hydraulic controlling system that optimizes operation of the internal combustion engine.

More particularly, it is an object of our invention to substantially stabilize the horsepower developed by the internal combustion engine in a hydraulic riding trowel notwithstanding sudden variances and fluctuations in rotor drive motor torque requirements.

A related object is to provide a hydraulic control system for riding trowels that helps to maintain the internal combustion drive engine within its intended horsepower and torque operating range.

A related object is to control rotor drive motor rpm in reaction to dynamically changing load conditions.

Another object of our invention is to prevent engine stalling.

Yet another object is to minimize fluctuations in trowel operation.

It is also an object to prevent or minimize the surface degradation that can result when the trowel encounters widely varying load and friction conditions.

Another object is to provide a hydraulic control system of the character described that is suitable for use with trowels having various types of hydraulic motors.

Yet another object is to provide a hydraulic control system of the character described that functions with rotor drive trains employing gearboxes.

Still another important object of our invention is to provide a hydraulic control system of the character described that is suitable for use with manually-steered, hydraulically driven riding trowels.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 1 is a combined tabular and graphical view illustrating known characteristics of concrete from initial mixing to advanced curing, showing the "window of finishability" of concrete as it cures;

DETAILED DESCRIPTION OF THE PREFERRED EMBODIMENTS

With primary attention directed now to FIG. 1, the concrete curing graph 21 plots heat against time through the five stages of hydration of freshly placed concrete. Time segment 22 indicates a time period in which troweling is preferably conducted, known as the "window of finishability." As discussed earlier, troweling ideally begins with panning as known in the art when the concrete is plastic, towards the left portion of segment 22. Troweling graduates to blading as concrete hardens during the hardening stage, towards the right of segment 22. However, as concrete hardens, there is no clear demarcation point mandating the transition from pan troweling to blade troweling. Similarly, on a job site, the exact condition of curing concrete contacted by a given trowel during its travel is far from uniform. Therefore a panning trowel will sometimes encounter concrete that should be trowelled with a blade, and blading trowels often contact more plastic regions of concrete that ideally require panning. The transition between regions of different surface frictional characteristics can result in inconsistent trowel movements and operation, sometimes damaging the surface being finished. Furthermore, sudden power increases needed to maintain RPM when the frictional load varies widely and suddenly can stall the internal combustion engine and overload the hydraulic power train.

Thus, as explained below, our new system prevents over loading of the internal combustion engine by monitoring the pressure applied to the rotor drive motors. When a maximum pressure set point occurs, a feedback signal is derived, and the pressure applied to pump control heads on the high pressure, hydraulic pump section is varied to prevent stalling of the internal combustion engine.

The above discussed Allen Engineering Corporation patents are hereby incorporated by reference, as if fully set forth herein, for purposes of disclosure. The hydraulic unloading valve circuitry is discussed in conjunction with FIGS. 8-13 detailed hereinafter.

Figure 2:
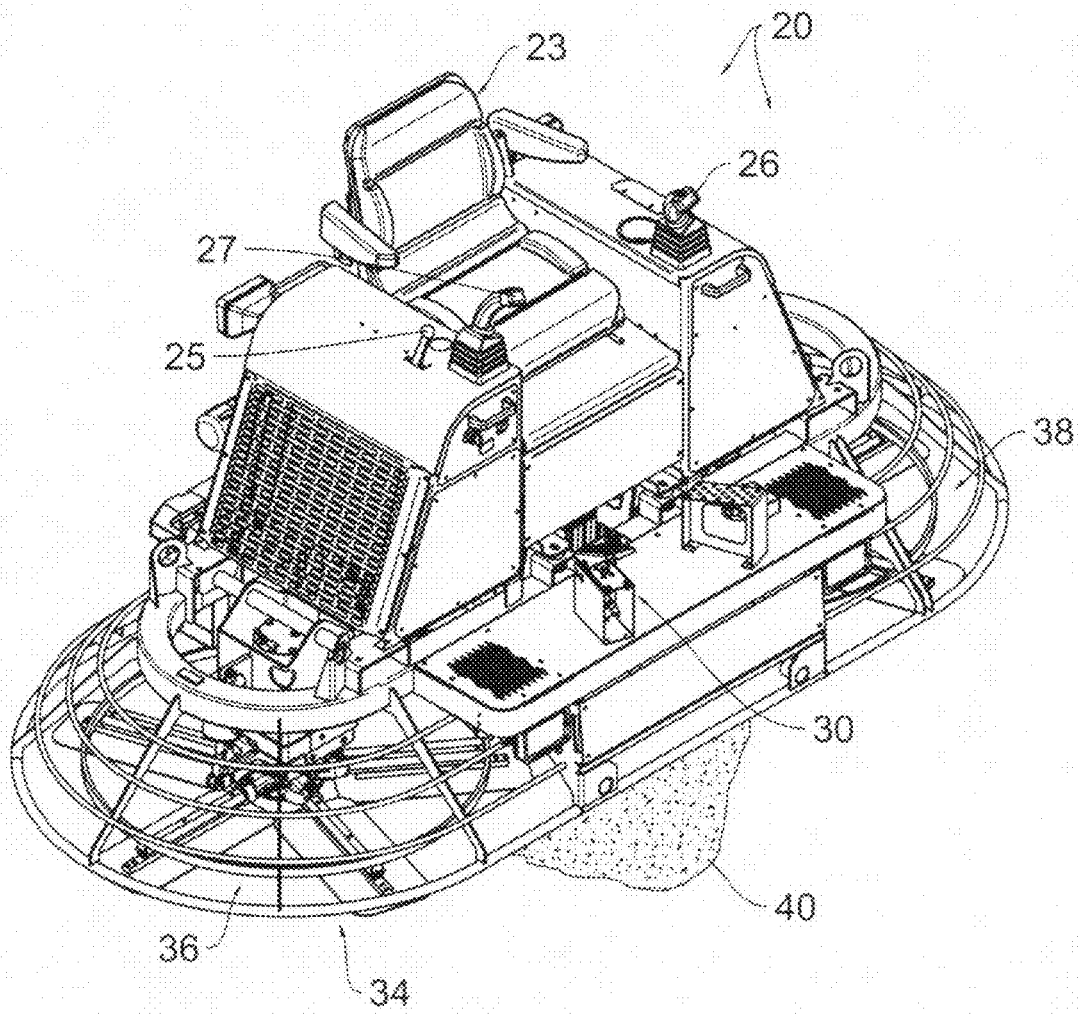
FIG. 2 is front isometric view of a hydraulically-driven and hydraulically steered, twin-rotor riding trowel incorporating the best mode of the invention.

In FIG. 2 of the accompanying drawings, the reference numeral 20 denotes a hydraulically-driven, hydraulically-steered riding trowel equipped with our new hydraulic circuit described hereinafter. An operator (not shown) comfortably seated within seat assembly 23 (FIG. 2) can operate trowel 20 (FIG. 2) with a pair of easy-to-use joysticks 26, 27 respectively disposed at the operator's left and right side. Details for the joystick controls are illustrated profusely in one or more of the above-referenced Allen patents which are incorporated by reference. As will be recognized by those skilled in the art, such joysticks may operate either "hydraulic-over-hydraulic" steering systems or "electric-over-hydraulic" steering systems.

A foot-operated, hydraulic pilot control valve 30 (FIG. 2) functions as rotor throttle for machine control. Valve 30 is accessible from seat assembly 23 that is located atop the frame assembly 34. Engine throttle is regulated by a hand operated lever 25 and controls only the internal-combustion engine RPM. Rotor throttle is only acquired when the operator depresses the foot-pedal 30. The RPM of the rotors is determined by the amount of pressure the operator applies to the foot-pedal. A pair of spaced-apart rotor assemblies 36 and 38 dynamically coupled to the frame extend downwardly into contact with the concrete surface 40 (FIG. 2) as is well known in the art. Each rotor assembly is independently, pivotally suspended from the trowel 20. Hydraulic riding trowels typically use diesel or gasoline drive engines, but alternate combustible fuels such as natural gas, hydrogen or E-85 blends can be used as well. As described in previously referenced Allen patents, the internal combustion motor drives suitable hydraulic pumps for powering the hydraulic circuitry and hydraulic parts discussed hereinafter. Preferably, each rotor assembly is driven by a separate hydraulic motor. The self propelled riding trowel 20 is designed to quickly and reliably finish extremely large areas of concrete surface 40, while being both driven and steered with hydraulic means.

Figure 3:
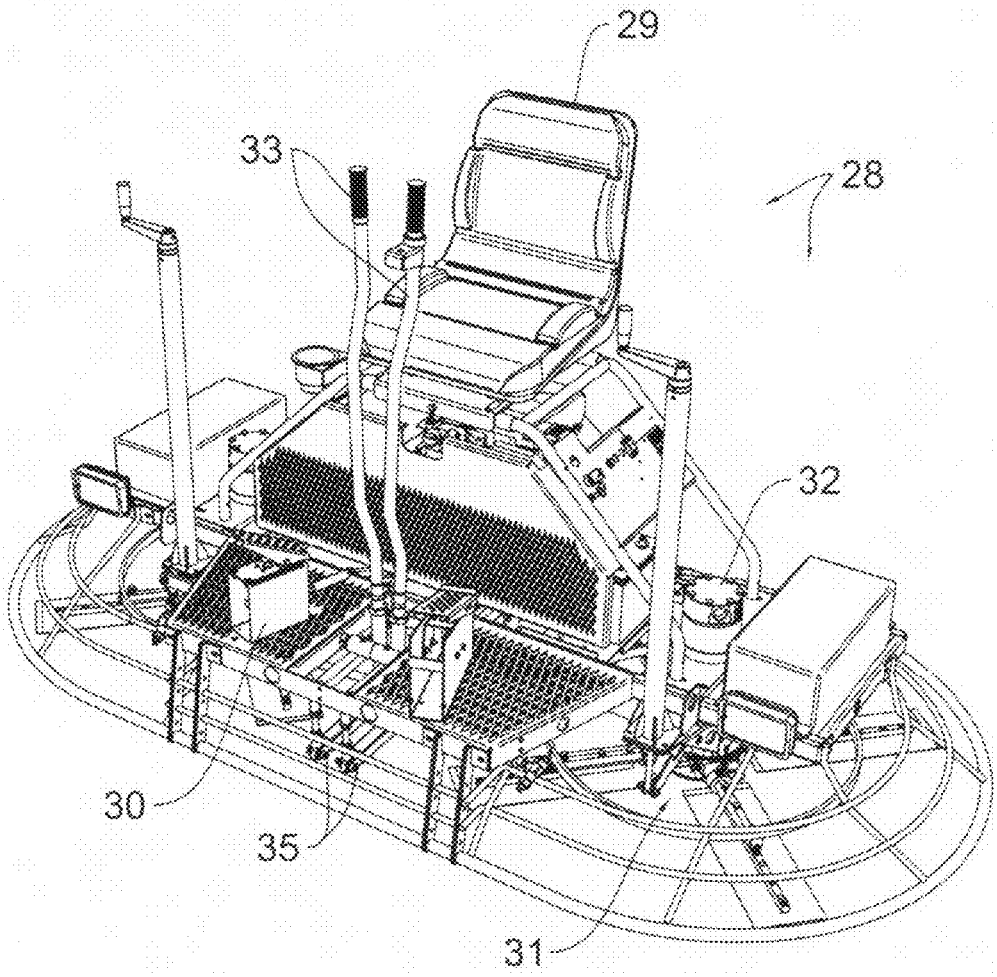
FIG. 3 is a front, isometric view of a hydraulically-driven and manually steered, twin-rotor riding trowel comprising an alternative embodiment of the invention.
Figure 4:
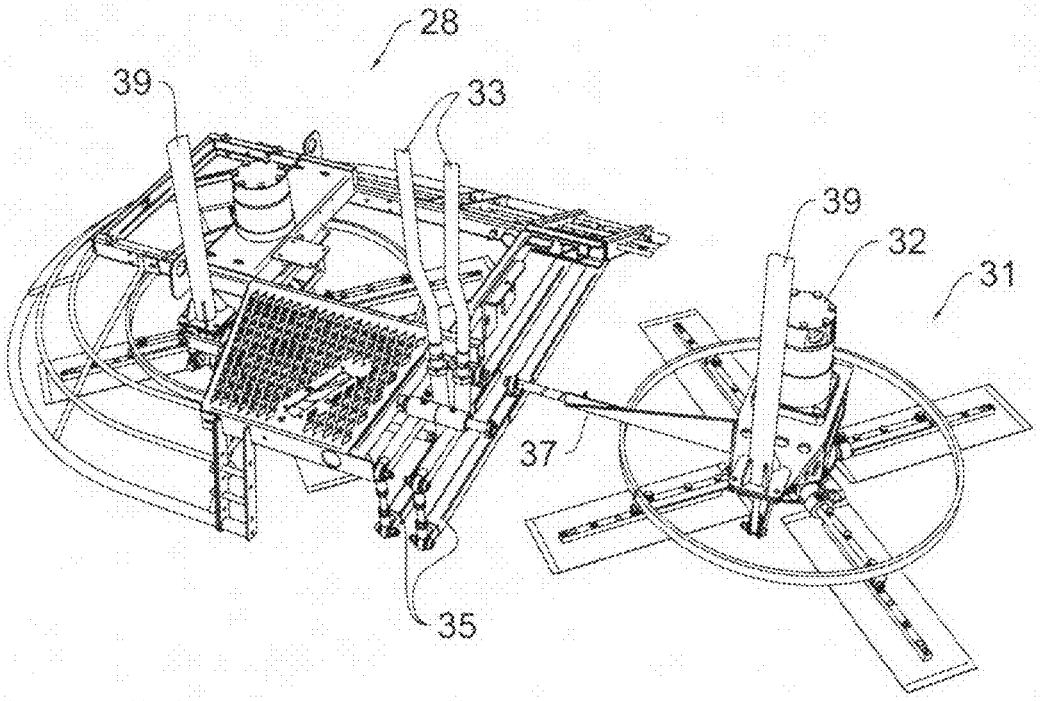
FIG. 4 is a fragmentary, front isometric view of the manually-steered trowel of FIG. 3, with portions thereof broken away for clarity and portions omitted for brevity.

Referring to FIGS. 3 and 4, a manually-steered, hydraulically driven riding trowel has been generally designated by the reference numeral 28. An operator sits atop the frame in a seat 29 that provides foot access to the critical foot-pedal 30 which is interconnected with the system to be described. The rotor assemblies 31 are driven by hydraulic motors 32. A pair of vertically upright, manually activated, primary control levers 33 activate the lower, parallel lever arms 35 to tilt the rotors for steering. Arms 35 deflect torque rods 37 (FIG. 4) to tilt the rotors 31 for steering. Pitch controls 39 are manually operated as well. Details as to manual pitch control and manual steering with levers 33 and lever arms 35 and rods 37 are seen in U.S. Pat. No. 5,108,220, owned by Allen Engineering Corporation, which is hereby incorporated by reference for purposes of disclosure.

Figure 5:
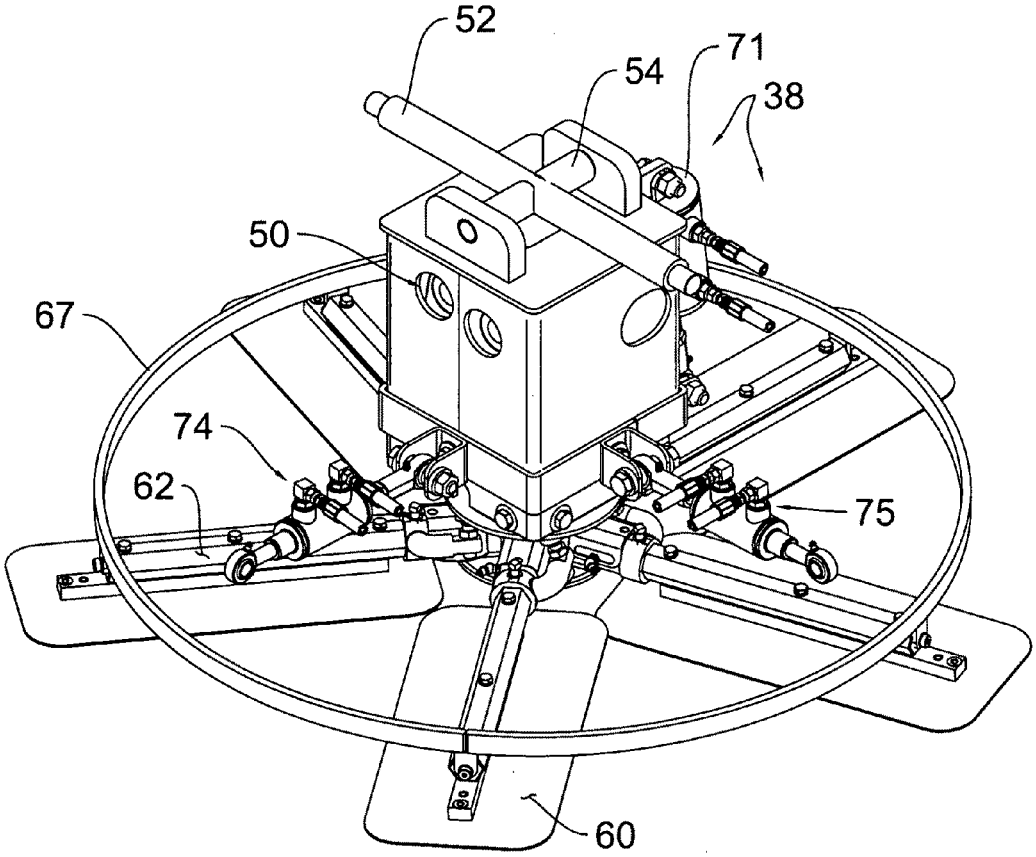
FIG. 5 is an enlarged, isometric view of a trowel rotor and a typical piston hydraulic drive motor, with portions thereof broken away for clarity or omitted for brevity.

Referring to FIG. 5, a suitable piston hydraulic drive motor 50 powers a typical rotor assembly 38 (or either rotor assembly) that can be used on hydraulic trowels 20 (FIG. 2) or 28 (FIG. 3). The four-way rotor assembly 38 and piston hydraulic motor 50 are pivotal fore-and-aft and left-to-right as established by twin pivot rods 52, 54 (FIG. 5), as is known in the art and explained in the aforementioned Allen patents which are incorporated by reference for purposes of disclosure. A plurality of radially spaced-apart blades 60 associated with the rotor are driven by hydraulic motor 50. As is well known, each blade 60 can be revolved about its longitudinal axis via a linkage 62 controlled by conventional pitch control cylinder 71. Preferably a circular reinforcement ring 67 (FIGS. 5, 7) braces the revolving blades. Tilting for steering and control is effectuated by horizontally disposed hydraulic tilting cylinders 74 and 75. Details of various hydraulic circuits, circuitry interconnections, and control apparatus are disclosed in the above mentioned patents.

Figure 7:
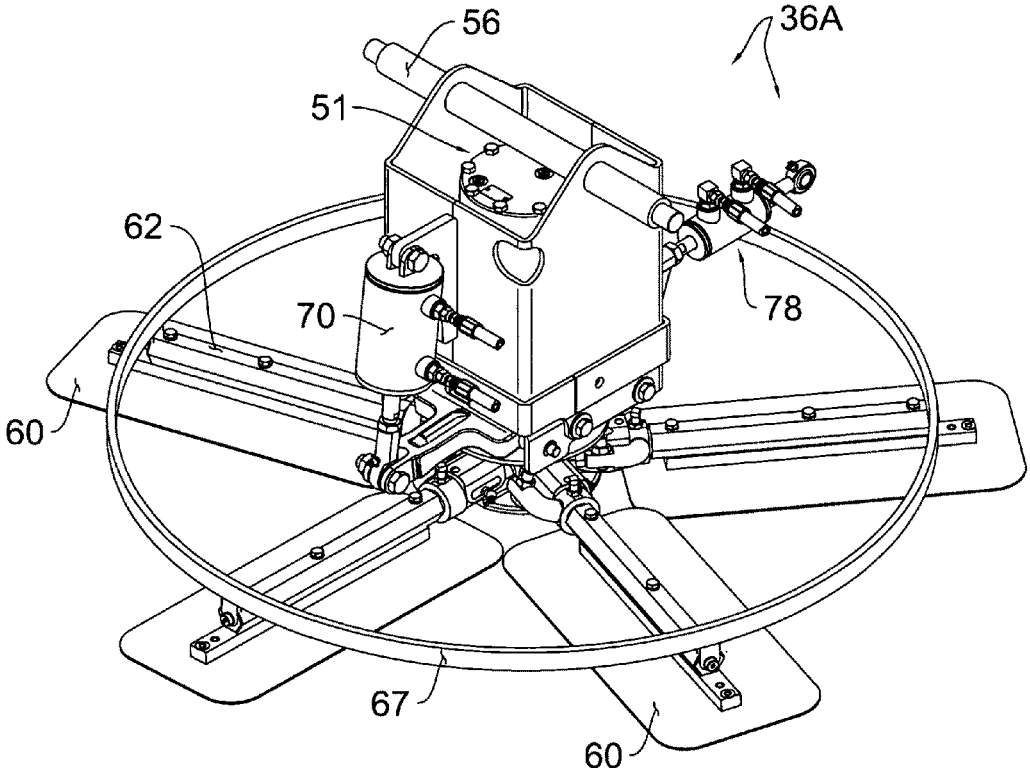
FIG. 7 is an isometric view of a rotor with an internal, "gear and vane" type hydraulic motor with portions thereof omitted for brevity.

As best seen in FIG. 7, a "gear and vane" motor may be used with either of the rotor assemblies of the hydraulic trowels 20 or 28. The two-way rotor assembly 36A (FIG. 7) and hydraulic "gear and vane" motor 51 are pivoted by a single pivot rod 56, as is known in the art. A vertically oriented hydraulic cylinder 70 controls blade pitch on rotor assembly 36A. Tilting cylinder 78 is used for steering. A suitable gear and vane motor is available from White Hydraulics under the trademark ROLLER STATOR.™

Relatively recent developments have suggested that a gearbox may be needed in specific applications for powering rotors in various trowels. Referencing FIG. 6, a typical trowel rotor has a plurality of radially spaced blades 60 as before, reinforced by an circling ring 67. The motor 73 can comprise a variety of hydraulic designs, including the piston type and "gear and vane" type motors discussed in conjunction with FIGS. 5 and 7. Motor 73 couples through mounting 76 and engages a gearbox 77 whose driveshaft 79 penetrates pressure plate 81. Fork 86 controls blade pitch in a conventional manner.

Figure 8:
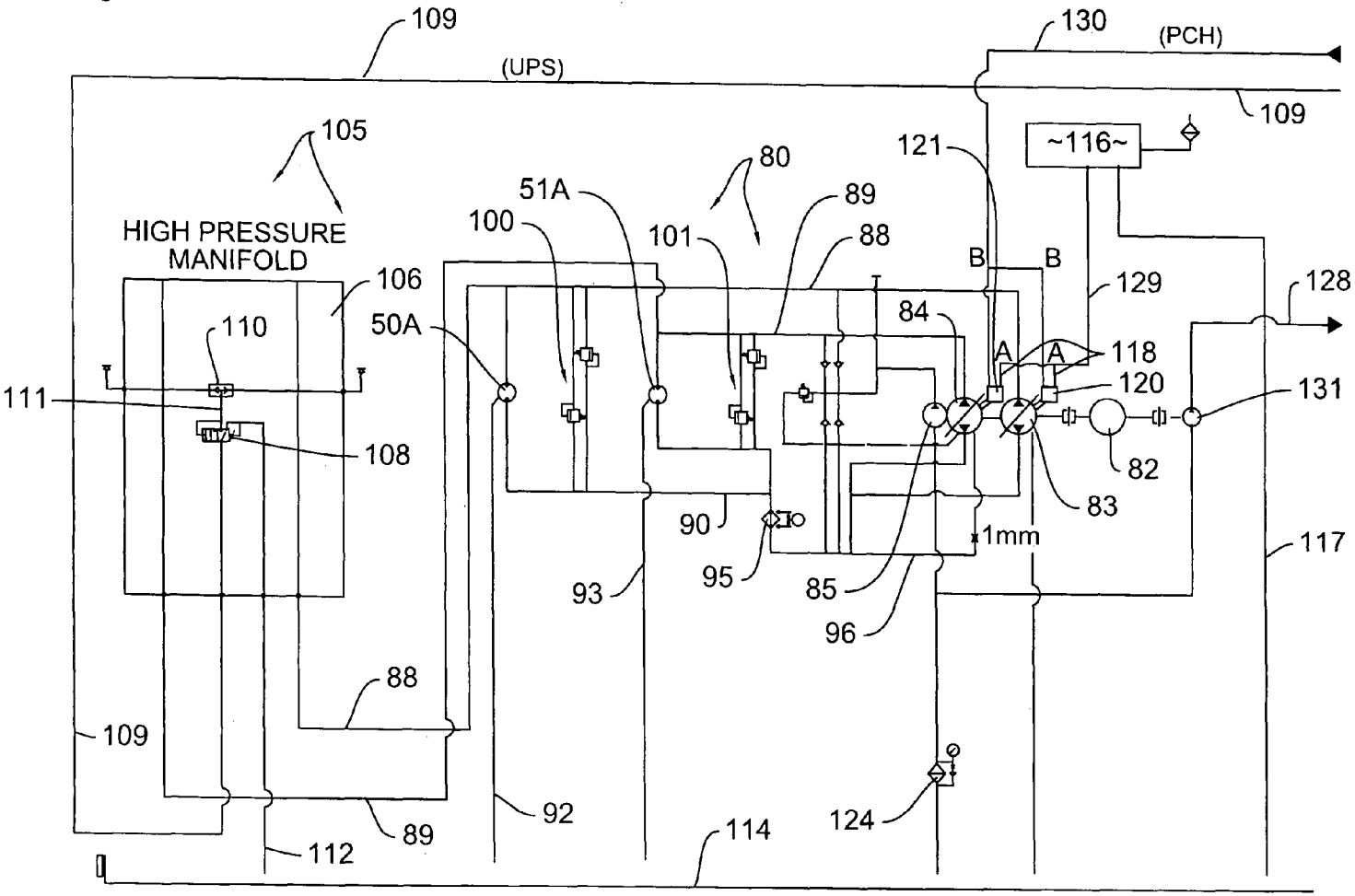
FIGS. 8 and 9 are detailed hydraulic schematic diagrams of the preferred hydraulic circuitry for hydraulically steered trowels with the invention known to us at this time.
Figure 9:
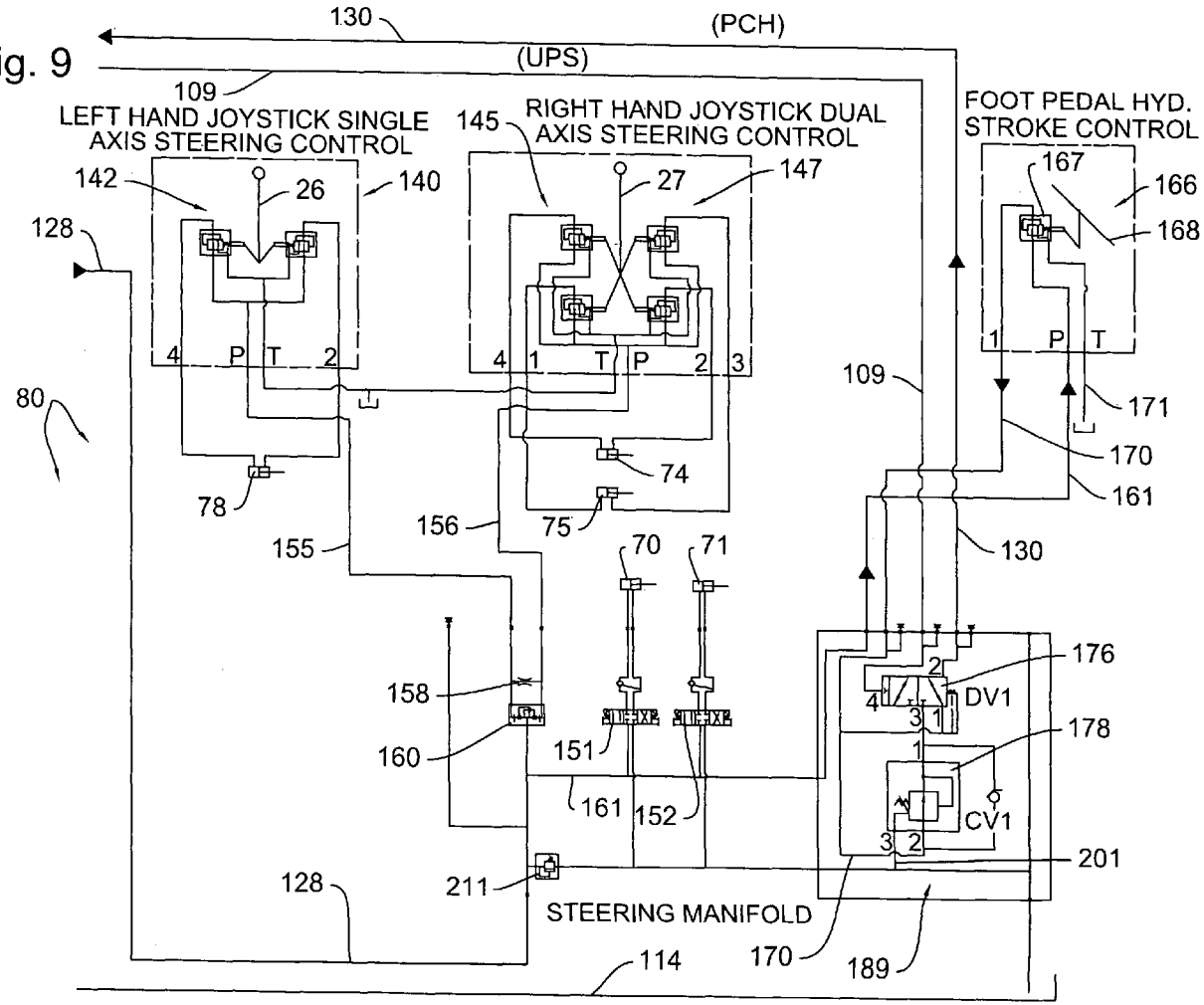
Figure 9A:
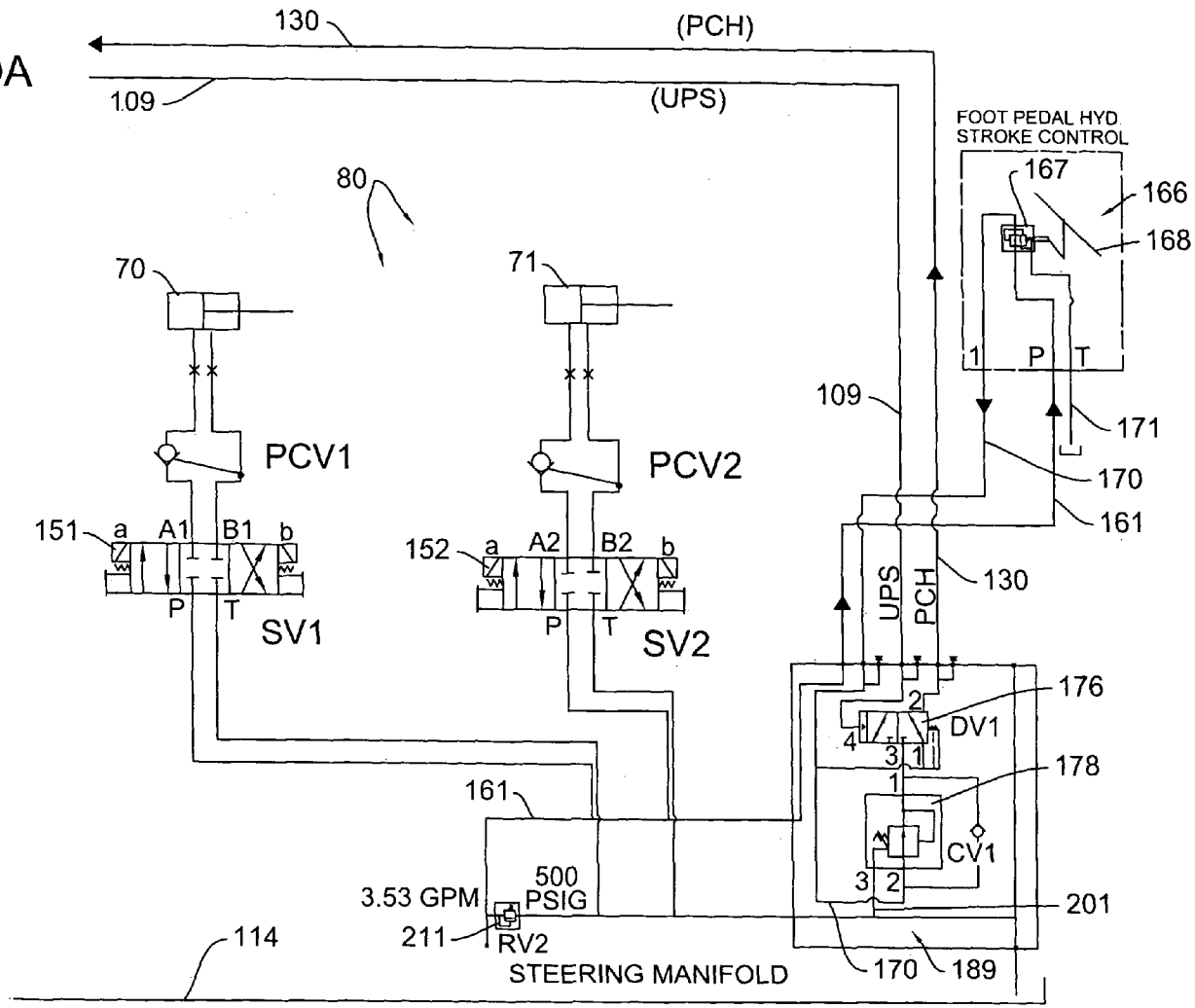
FIG. 9A is a detailed hydraulic schematic diagram that can be substituted for FIG. 9 to show preferred hydraulic circuitry for use with manually steered trowels like that of FIG. 3.

Trowels 20 and 28 includes unique hydraulic systems for controlling dynamically varying friction and load fluctuations encountered in demanding use. The preferred load control circuitry seen in FIGS. 8 and 9 is used with hydraulically driven and hydraulically steered trowels. The alternative circuitry seen by combining FIGS. 8 and 9A is used for hydraulically driven trowel 28 (FIG. 3) that are manually steered. The circuitry prevents overloads and drive engine stalling.

Figure 10:
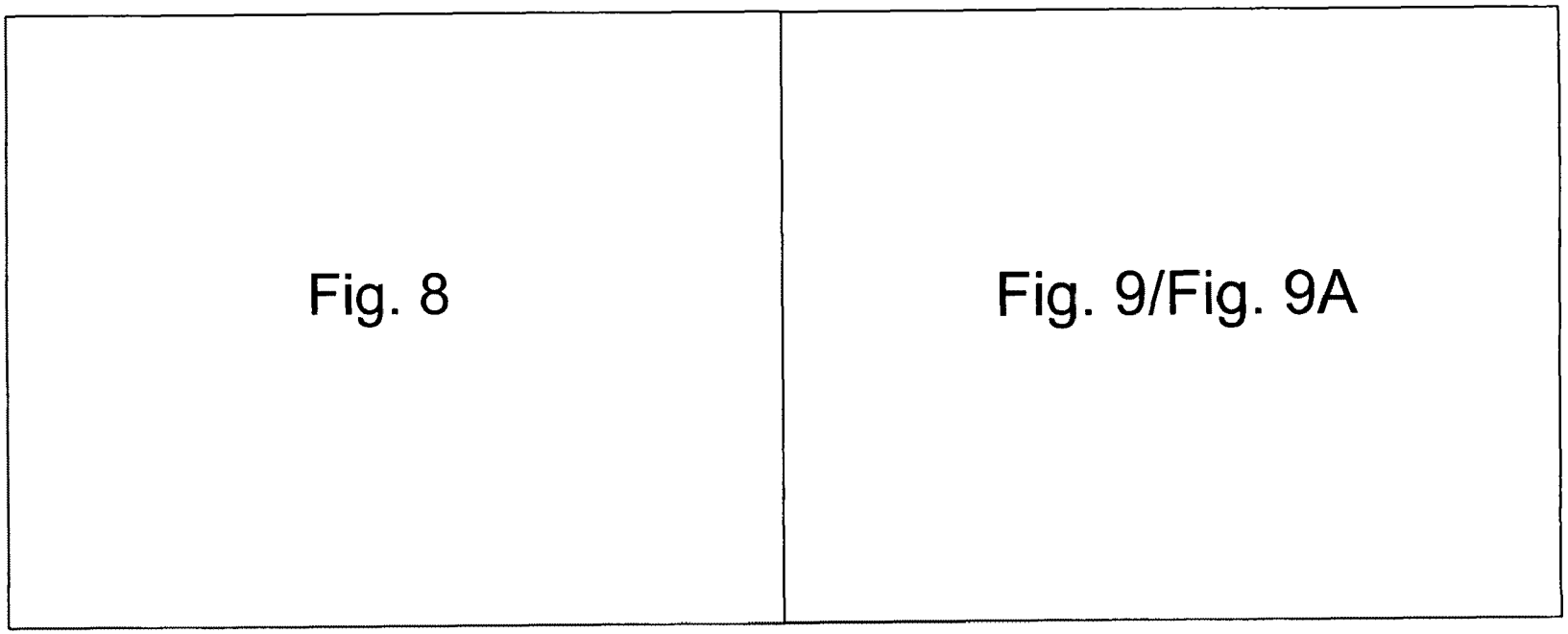
FIG. 10 is a diagrammatic view illustrating how FIG. 8 should be aligned with FIG. 9 or 9A for viewing.

Referencing FIGS. 8 and 9, that should be combined as in FIG. 10, the circuit has been broadly designated by the reference numeral 80. A generic internal combustion trowel engine has been schematically indicated by the reference numeral 82 (FIG. 8). Engine 82 (FIG. 8) drives primary hydraulic pumps 83 and 84, a charge pump 85, and an auxiliary pump 131. High pressure fluid from pump 83 is delivered via high pressure line 88 to a generic hydraulic drive motor 50A that can comprise on or more types of motors as discussed earlier. Pump 84 drives generic drive motor 51A through high pressure line 89. The motors 50A, 51A may or may not return case drain fluid to a reservoir tank through optional case drawing lines 92 and 93 (FIG. 8) respectively. A low pressure output from each motor 50A, 51A is connected via line 90 through oil cooler 95 and oil line 96 to inlets of pumps 83 and 84. Preferably hydraulic rotor drive motors 50A, 51A are protected by pairs of cross over relief valves 100, 101 that prevent damage from extreme overpressure.

Viewing the left side of FIG. 8 it is seen that the high pressure rotor-motor drive lines 88, 89 are both connected to an unloader pressure signal (i.e., "UPS") circuit 105 which senses pressure and derives a feedback signal. The "UPS" control circuit 105 is part of an unloader valve assembly 107

Figure 11:
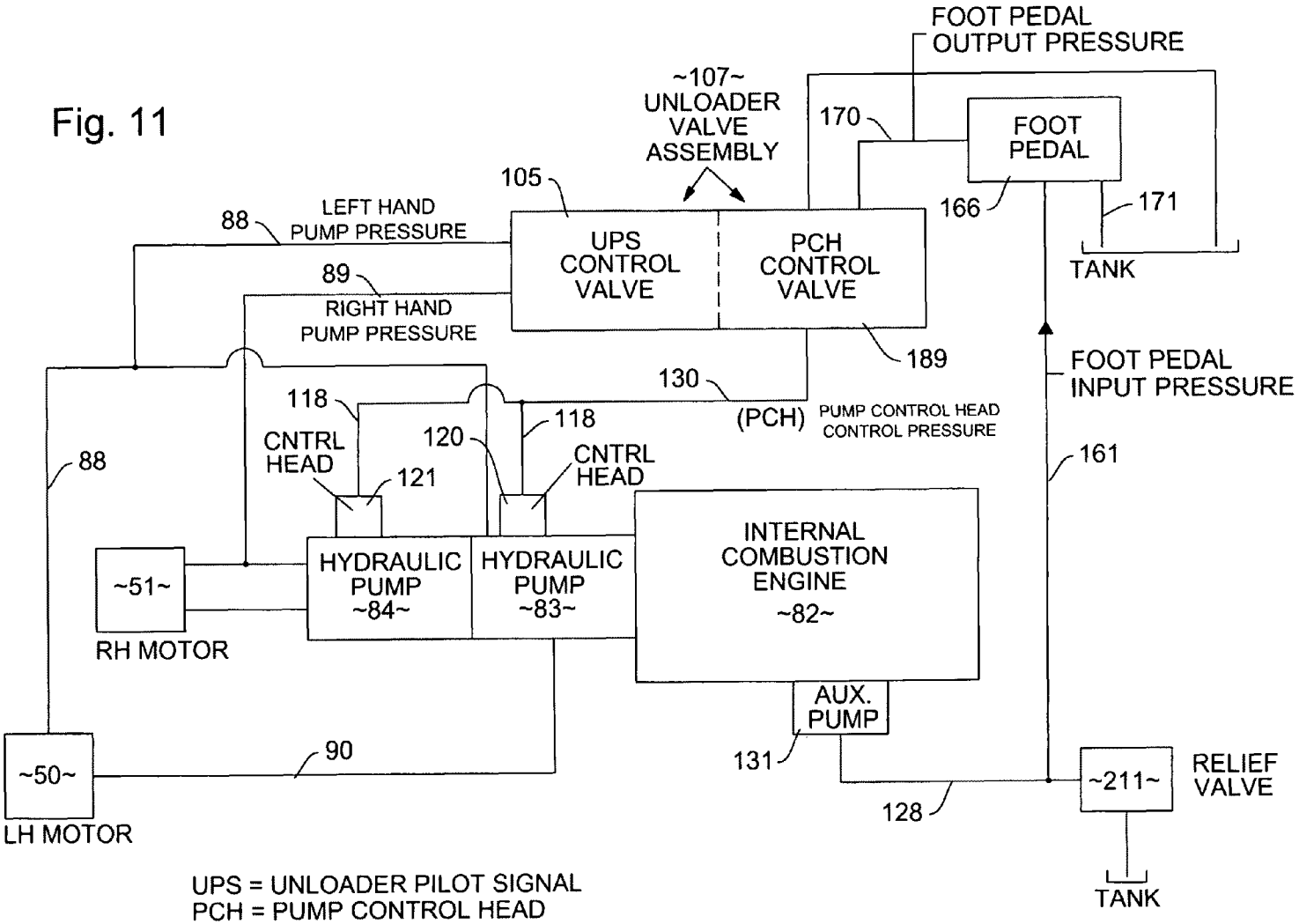
FIG. 11 is a simplified block diagram illustrating basic operation of the hydraulic control circuitry, showing only fundamental components.
Figure 12:
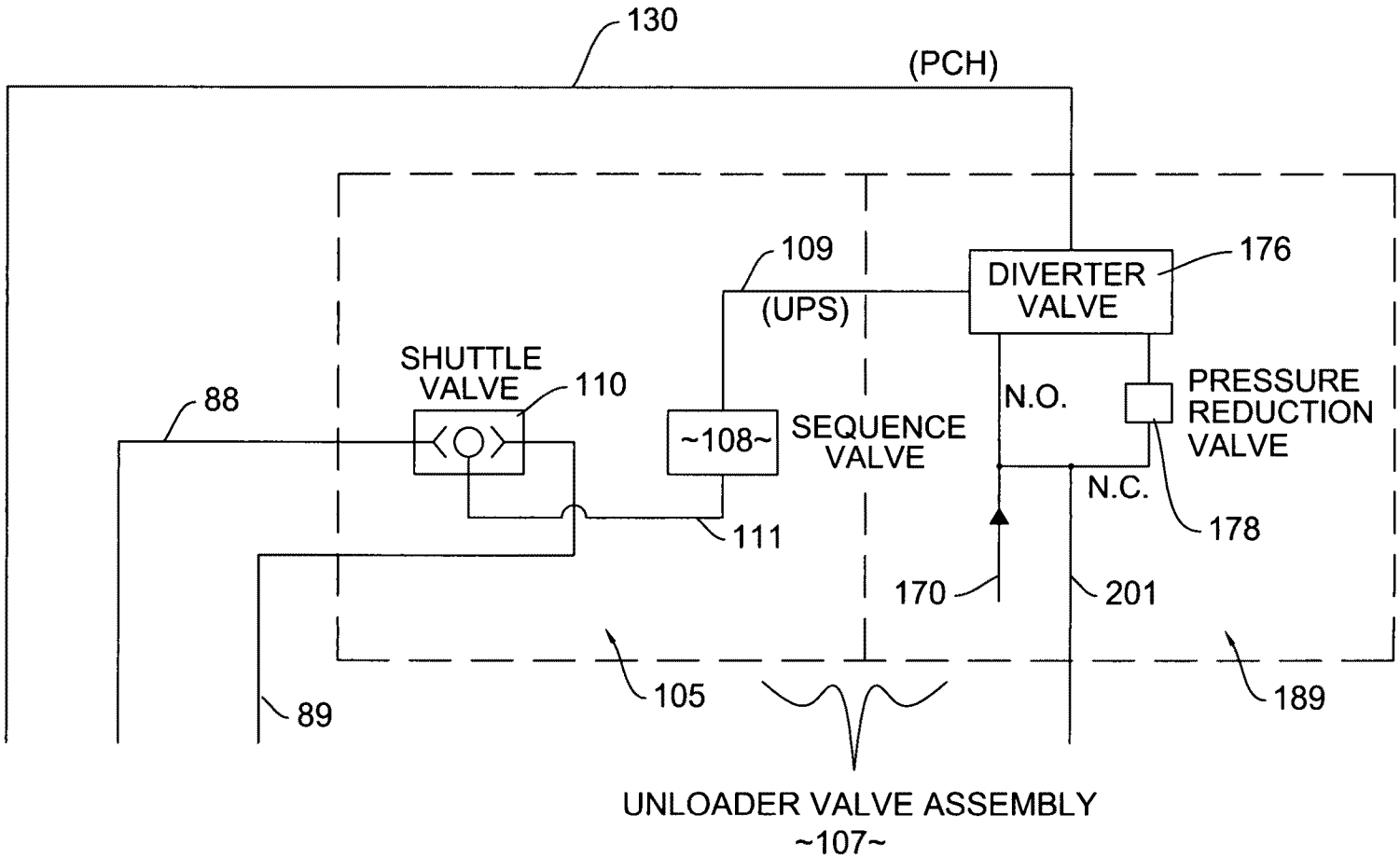
FIG. 12 is a detailed block diagram of the unloader valve assembly of FIG. 11.

(FIGS. 11, 12). Assembly 107 includes a "Pressure Control Head" (i.e., "PCH") circuit 189 explained later and detailed in FIGS. 9 and 12. UPS control circuit 105 comprises a manifold 106 preferably made of hardened steel that is subjected to high pressures. Circuit 105 monitors pressure applied to the rotor drive motors 50A, 51A with a shuttle valve 110 in communication with both high pressure drive lines 88, 89 that alternates between them. Valve 110 communicates through a sequence valve 108 via a line 111.

When an overpressure condition is detected on either line 88 or 89 (i.e., when either hydraulic drive motor 50A or 51A is over-pressured), pressure-sequence valve 108 (FIGS. 8, 12) is activated. The system checks for an optimum pressure set point. Return line 112 runs back from sequence valve 108 to the reservoir tank 114. Importantly, a corrective feedback signal is outputted from valve 108 on line 109. The "unloader pilot signal", hereinafter designated "UPS", ultimately provides corrective feedback to moderate rotor RPM and prevent stalling of internal combustion engine 82. The "PCH Control Section" 189 (FIG. 9) of the unloader valve assembly 107 (i.e., FIGS. 11, 12) responds to the UPS signal appearing on line 109 (FIGS. 8, 9, 12). PCH Section 189 generates a "Pilot Control Signal" (i.e., PCH signal) that is transmitted along line 130 (FIGS. 8, 9, 12) to the control heads on high pressure pumps 83, 84 as detailed hereinafter.

The internal combustion engine 82 (FIG. 8) also drives an auxiliary pressure pump 131 that can be used for steering (i.e., rotor tilting), rotor blade pitch control, and the rotor foot pedal control that is schematically designated as 166 in FIGS. 9, 9A. Pump 131 outputs on line 128 leading to FIG. 9. Charge pump 85 and auxiliary pump 131 (FIG. 8) are supplied with suction oil via filter 124.

Breather tank 116 (FIG. 8) facilitates air release on line 129 from separate pilot control heads 120, 121 associated with the pumps 83, 84 (FIG. 8). Line 129 is interconnected via lines 118 to pilot control heads 120, 121. Line 117 from breather tank 116 (FIG. 8) returns to reservoir 114. The pilot control heads are part of a standard pump. UPS control circuit 105 applies the unloader pilot signal (i.e., "UPS" signal) on line 109 originating on the left side of FIG. 8 that leads to FIG. 9. Line 130 at the top right of FIG. 8, a pilot control head line (i.e., hereinafter "PCH" line), drives the pump control heads 120, 121 (FIG. 8). Pressure applied to these heads via PCH line 130 normally controls rotor speed by the foot pedal control 166 (FIG. 9). PCH line 130 drops in pressure in response to the PCH circuit diverter valve arrangement discussed below. The pilot control heads 120, 121 are normally controlled by the operators' foot-pedal 30 (FIG. 3) that is schematically designated as 166 in FIG. 9. Varying pressure applied along PCH line 130 normally established by operator depression of the foot-pedal 30 (FIG. 1) enables the operator to vary rotor RPM.

Figure 6:
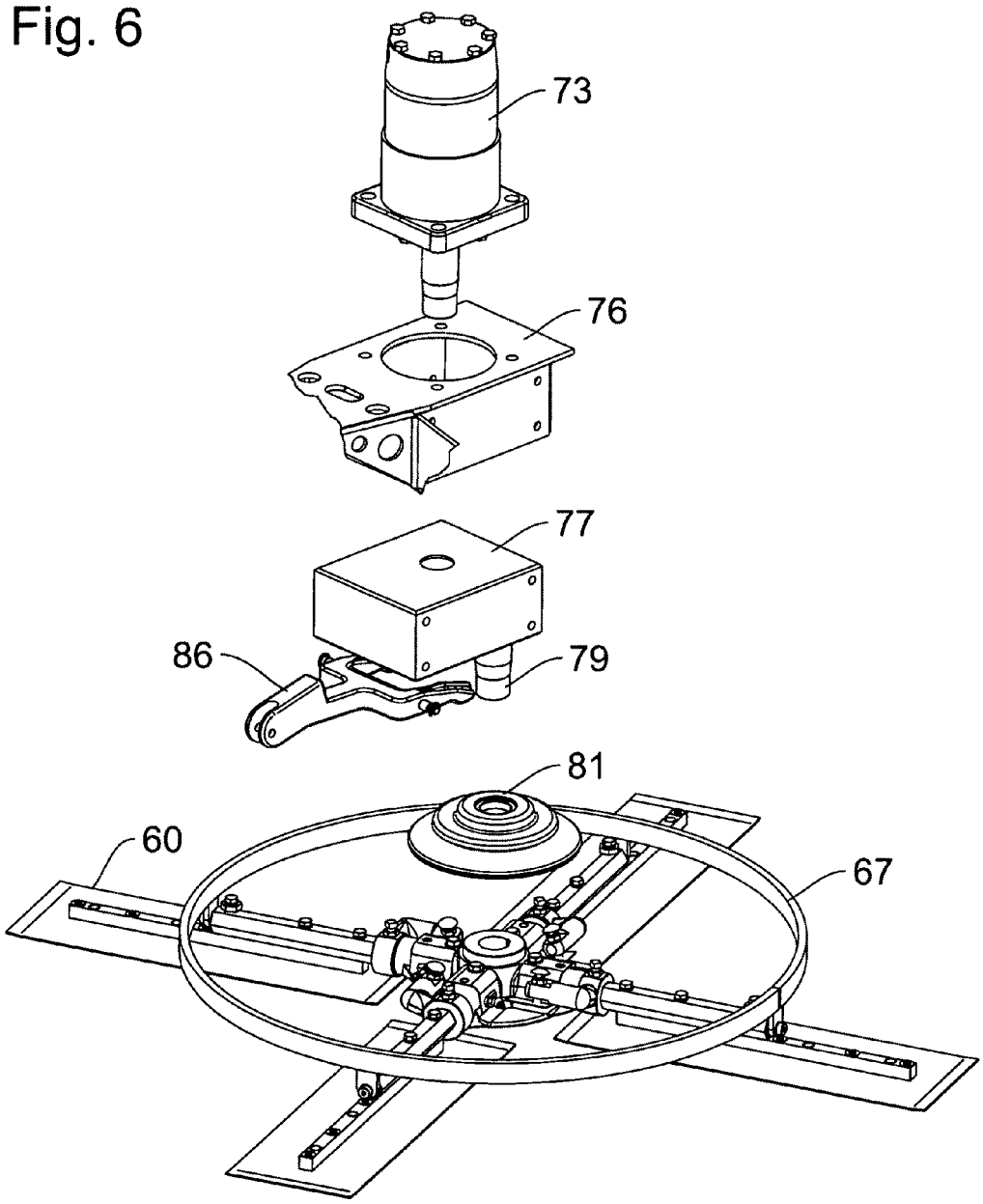
FIG. 6 is an exploded, isometric, fragmentary assembly view of a gearbox-actuated rotor suitable for use with the trowels of FIGS. 2 and 3.

Referring to FIGS. 8 and 9, pressure appears on line 128 from auxiliary hydraulic pump 131 that powers steering (i.e., in hydraulically steered trowels 20), and pitch and foot-pedal control. Joystick steering control 140 (FIG. 9) controls rotor assembly 36 (FIG. 7) with a left-mounted joystick 26 (FIGS. 2, 9). Joystick 26 operates a pair of pressure reducing valves 142 that control the steering cylinder 78 (FIG. 7). The joystick steering control 145 (FIG. 9) uses right side joystick 27 (FIGS. 2, 9) to control four pressure reducing control valves 147 to operate the twin steering cylinders 74, 75 associated with rotor assembly 38 (FIGS. 5, 6). Pitch control cylinders 70, 71 are controlled by four-way solenoid valves 151, 152. Lines 155, 156 respectively supply steering controls 140, 145 which are connected to an equalizer 158 and a flow divider 160 leading to pressure lines 128. Line 128 connects to line 161 that applies pressure to the foot pedal controller 166. A pilot valve 167 controlled manually by a foot pedal linkage 168 outputs pressure on line 170. A foot pedal controller tank return is indicated at line 171.

The manually steered trowel 28 (FIG. 3) uses circuitry as viewed in FIGS. 8 and 9A that omits various previously described parts otherwise used for hydraulic steering. For example, by viewing and comparing FIGS. 9 and 9A, it is seen that joystick steering control 140, joystick 26 pressure reducing valves 142 and cylinder 78 are unnecessary. The joystick steering control 145 joystick 27, valves 147 and cylinders 74, 75 are omitted as well. Equalizer 158, flow divider 160 and lines 155, 156 are omitted in the best mode in the manually steered trowel as well.

The UPS line 109 drawn at the top of FIGS. 9 and 9A runs to PCH Control 189 that is associated with the unloader valve assembly 107 discussed earlier. PCH Control 189 is activated by, and hydraulically associated with the UPS control circuit 105. This relationship is indicated by the dashed lines in FIG. 12 surrounding the unloader valve assembly 107. In the best mode, trowels made in accordance with the invention have the PCH control 189 mechanically or physically separate from the UPS control circuit 105. The manifold portion of the PCH control is subjected to relatively lower pressures than manifold 106, and hence may be made of lower weight aluminum. In retrofit kits for practicing the invention, the manifolds associated with UPS control 105 and PCH control 189 may be combined in one unit.

As seen in FIGS. 9 and 9A, UPS line 109 inputs to PCH control 189. The PCH output line 130 extends from PCH circuit 189 (FIG. 9) back to the control heads 120, 121 (FIG. 8). UPS line 109 connects to a diverter valve 176 that is coupled to a low pressure adjustment valve 178 that drains to line 201. Auxiliary pump 131 supplies foot pedal control 166 (FIG. 9) with pressure across relief valve 211 (FIGS. 9 and 11) through line 161 into foot pedal control valve 167. Fluid flow through valve 167 is selected by the operator foot pedal activating linkage 168. Line 170 outputs fluid from the foot-pedal control valve 167 to PCH circuit 189. Normally, fluid traveling through foot pedal control valve 167 travels through PCH valve 176 into the PCH line 130, being delivered to control heads 120, 121 for normal control of the pumps 83, 84 (FIG. 8). However, when UPS line 109 triggers valve 176, the normal path of fluid on line 170 directly through valve 176 is interrupted, and fluid from line 170 is diverted to pressure reduction valve 178.

When the UPS signal appears on line 109, fluid from line 170 is diverted to valve 178. The fluid diverted from the foot-pedal control valve line 170 is passed by valve 178 to valve 176 and then to PCH line 130 at a reduced pressure. Any pressure above the set reduced pressure of valve 176 is relieved to line 201. The PCH circuit 189 automatically triggers in response to the optimum pressure set point in circuit 105 previously discussed, reducing the pilot control heads 120, 121 pressures automatically without operator intervention to control rotor output RPM.

Operation

Figure 13:
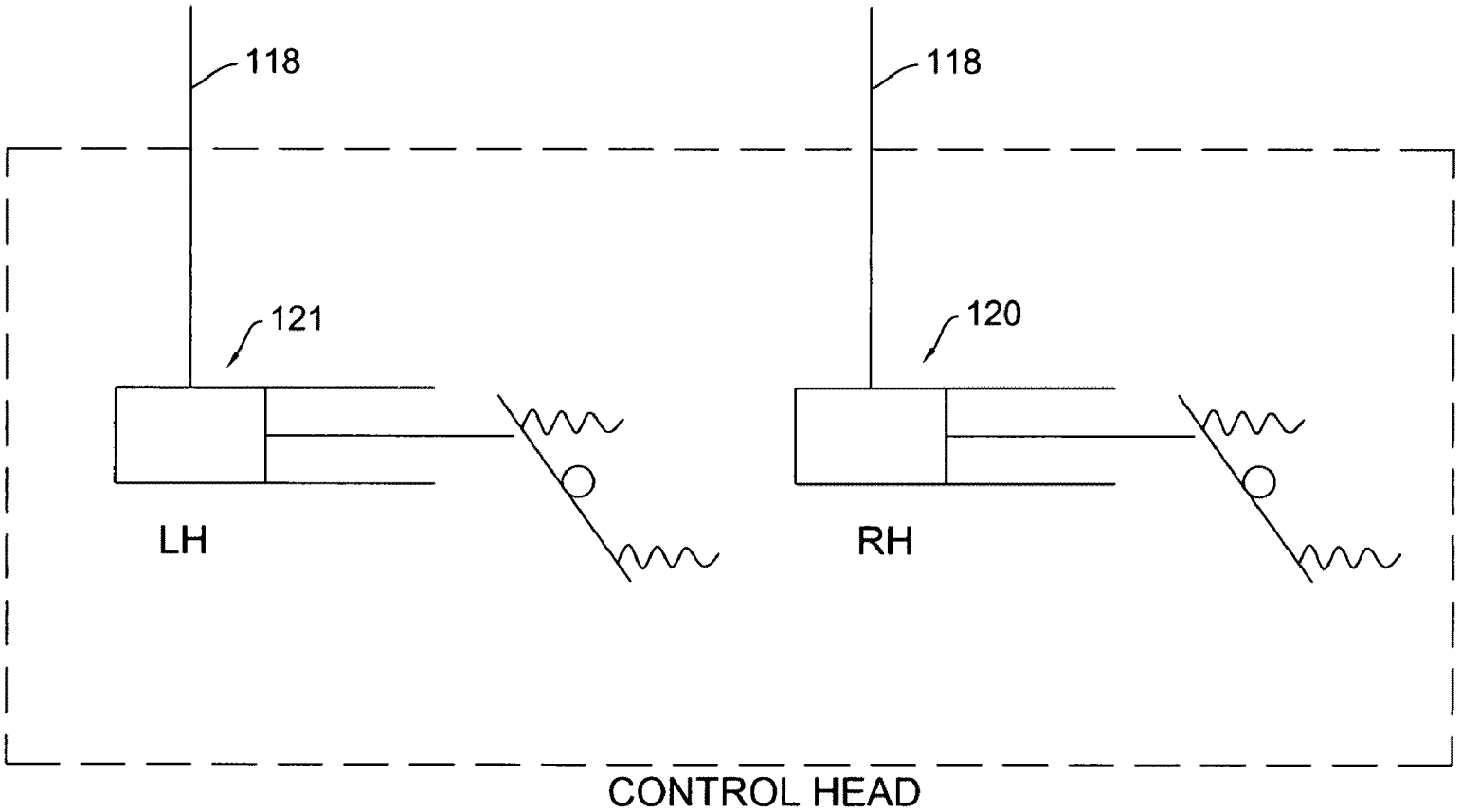
FIG. 13 is a diagrammatic view showing the control heads of FIG. 11.

Trowel unloader valve operation is illustrated in the simplified block diagrams of FIGS. 11-13.

The rotor hydraulic drive motors 50A and 51A are respectively operated by primary pumps 83, 84, with high pressure appearing on lines 88, 89. As seen in FIG. 11, the high pressure value is sensed by unloader valve assembly 107, specifically the UPS control 105. The UPS control 105 signals PCH control 189, varying the PCH line 130 which dynamically controls the pump control heads 120, 121.

The foot-pedal assembly 166 in FIG. 11 receives pressure from line 161, and outputs variable, user selected pressure on line 170. The output pressure on line 170 is either applied directly to PCH line 130 by PCH control 189, or it is reduced in pressure in response to the UPS signal from control 105.

Referring additionally now to FIGS. 12, and 13, the pressured lines 88, 89 entering the unloader valve assembly 107 reach the UPS control 105. Shuttle valve 110 monitors input drive pressure on both hydraulic rotor motors. When either or both rotor motors 50A, 51A (i.e., FIG. 8) reach optimum set point pressure, sequence valve 108 responds by outputting a UPS signal on line 109. The UPS signal reaches normally open flow diverter valve 176 in the PCH circuit within assembly 107. As long as sensed pressures within lines 88, 89 are normal, valve 176 (and thus unloader valve assembly 107) provides normal control via lines 118, 130 (FIG. 11) to the control heads 120, 121 on the hydraulic pumps 83, 84. The operator foot pedal controls rotor speed. However, when the optimum set point pressure condition occurs, the diverter valve 176 (FIG. 12) blocks normal flow by closing its normally open path, and fluid from line 170 is redirected through the normally closed path via adjustment valve 178 and then through valve 176 to PCH line 130. The pressure on line 130 is reduced immediately.

The lowered pressure achieved by valve 178 (FIGS. 9, 12) supersedes foot pedal control for adjusting rotor speed. Lowered pressure on lines 118 (FIG. 13) and PCH line 130 causes the control heads 120, 121 to forcibly adjust the swash plates within the drive pumps 83, 84 to reduce pump flow. Because of the load sensing system shown in FIGS. 8, 9 the operator will not experience foot-pedal kickback.

Figure 14:
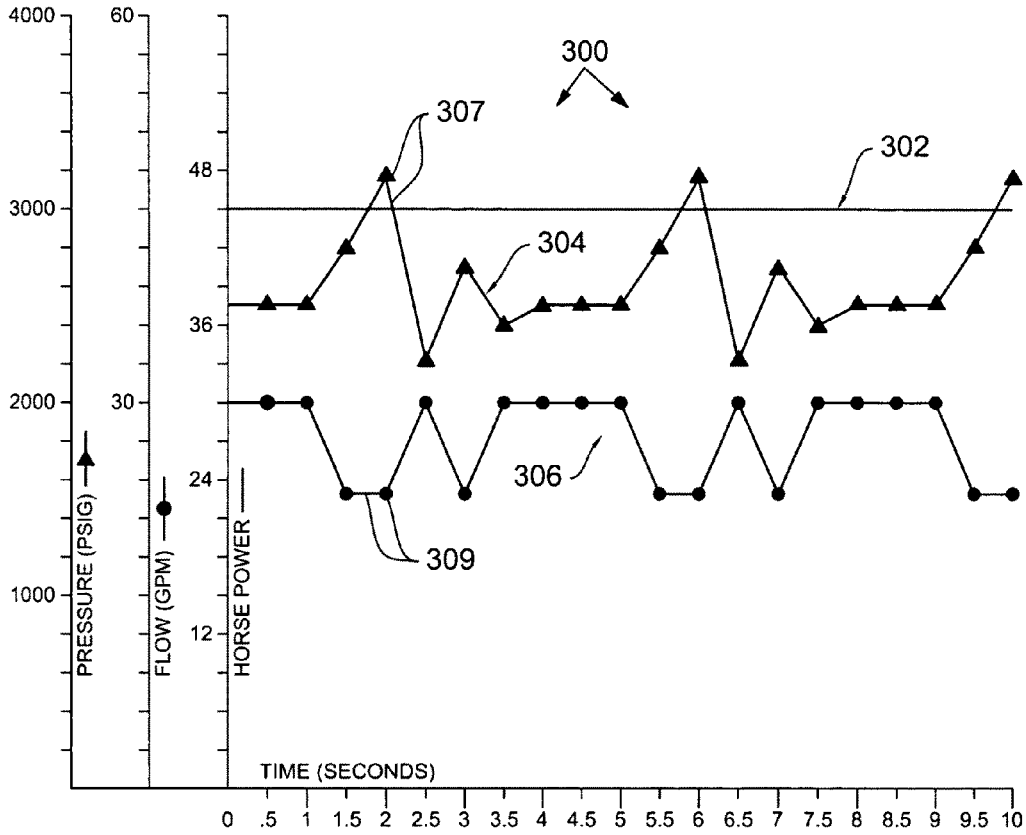
FIG. 14 is a theoretical trowel operating graph showing pressure, flow and horsepower relationships associated with the invention.

Referring to FIG. 14, graph 300 depicts theoretical trowel operating parameters with the invention. Averaged horsepower of the internal combustion engine is plotted against time on line 302. Lines 304 and 306 respectively designate rotor drive motor pressure and flow. It can be observed that when a pressure surge occurs, as at 307, a corresponding flow rate drop is observed at 309. Through the various spikes and variances in the flow rate and pressure parameters, observed horsepower achieved by the internal combustion engine is substantially constant, so engine RPM is substantially constant, and efficiency is promoted while stalling is prevented.

Figure 15:
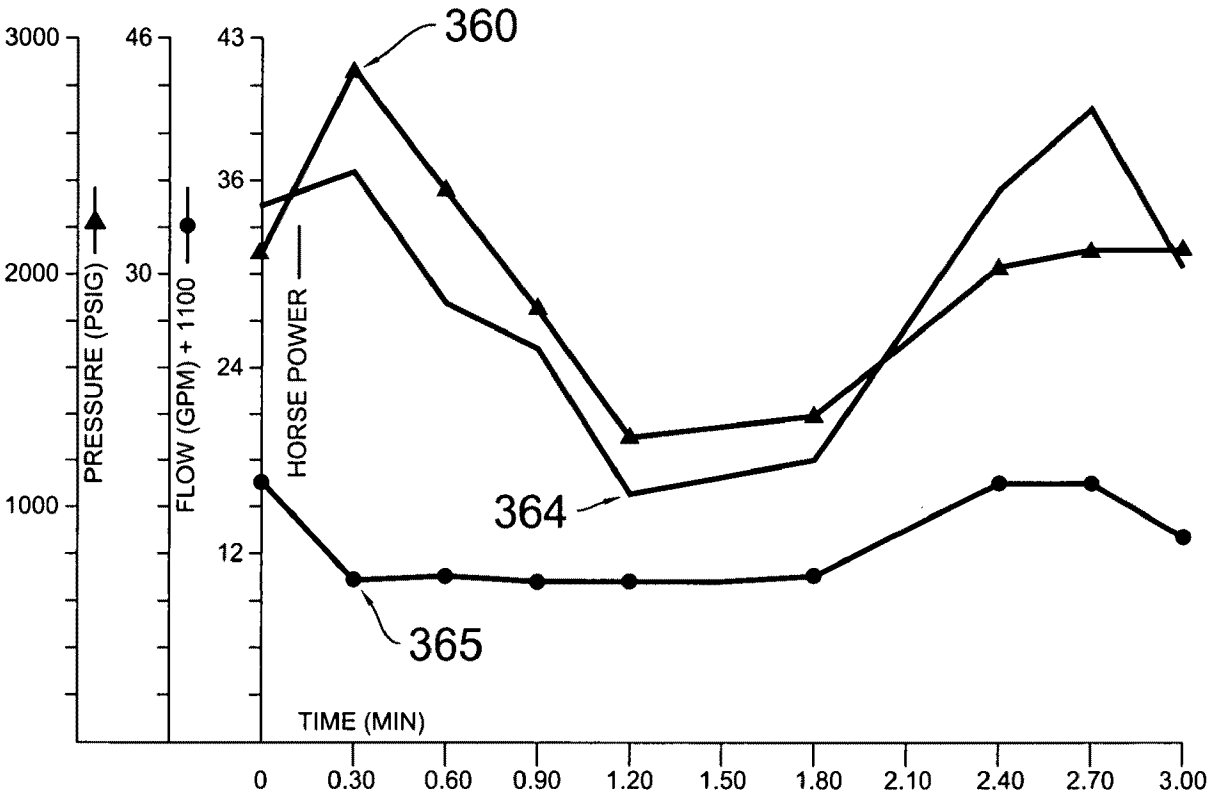
FIG. 15 is a simplified graph indicating actual system performance without the invention installed.

FIG. 15 is a typical graph of data collected that indicates the need for an unloader circuit of the type described herein. With no unloader installed, point 360 indicates a spike of approximately 2641 PSI loading the system. This load represents a drag on the rotor rotation and demands more pressure to accommodate the load. As a result of the loading, the engine cannot provide adequate horsepower to sustain the hydraulic demand, as indicated at 364. This results in a drop in the engine rpm which is shown by the resulting drop in flow to 12 GPM at 365 from normal 15.5 GPM. The opposite rotor suffers the same problem due to the engine rpm drop. All of this was caused by the load from the concrete causing a sharp increase in pressure at 360 which exceeded the available torque of the engine.

Figure 16:
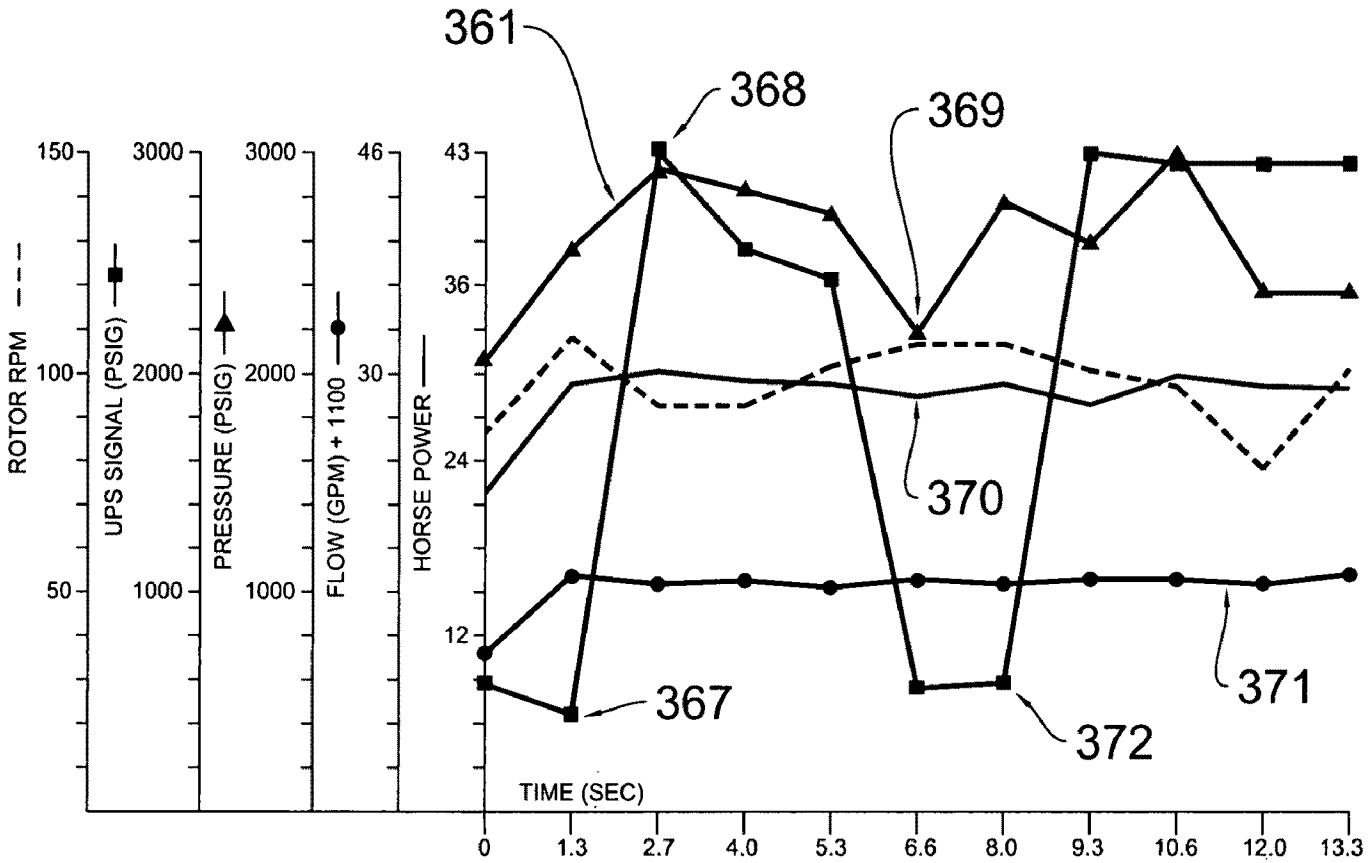
FIG. 16 is a simplified graph indicating actual system performance with the invention installed.

FIG. 16 is a simplified graph of actual data collected in the field with the invention in use. The purpose of the invention is to provide an automatic hydraulic load sensing system where by the ride on trowel can continue to operate at optimum performance throughout the concrete hardening stage as depicted on the hydration curve (FIG. 1).

A load demand is seen at 361 and is caused by excess pressure on the rotor. A low UPS signal at 367 of 660 PSI activates in response to excess pressure at 361. The UPS signal at 368 is now shown to be 3059 PSI. Now at 369 the system pressure is reduced to 2116 PSI with a resulting rise in the rotor RPM to 109. It is noticed that only a slight drop in horsepower occurs at 370. The flow however remains steady shown at 371. The next occurrence of the UPS activity is at 372.

Figure 17:
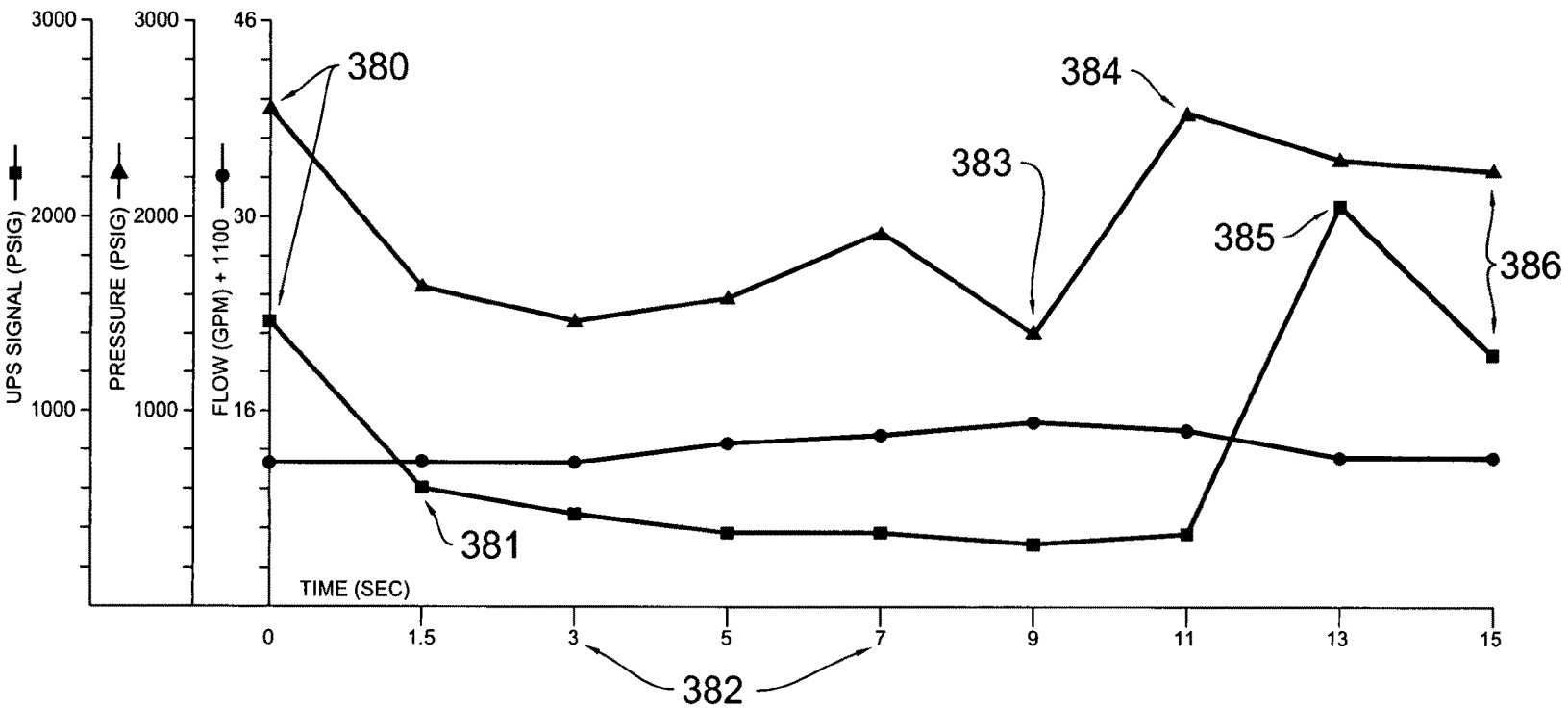
FIG. 17 is a simplified graph showing unloader operation.

FIG. 17 is an actual graph showing the operation of the invention. The unloader has acted due to loading as shown by the decrease of flow and high pressure at 380. The unloader is inactive as noted at point 381 due to lowered pressures. Thru the 3 to 7 second cycle there is normal operation as shown through time interval 382. Light load is being experienced as depicted by the low pressure and high flow at point 383. A sudden load is obvious at point 384 due to the increase in pressure and lack of unloader reaction. The unloader reaction is seen at point 385, decreasing flow and high pressure is visible. The pressure has dropped at point 386 and the unloader is reducing control.

Figure 18:
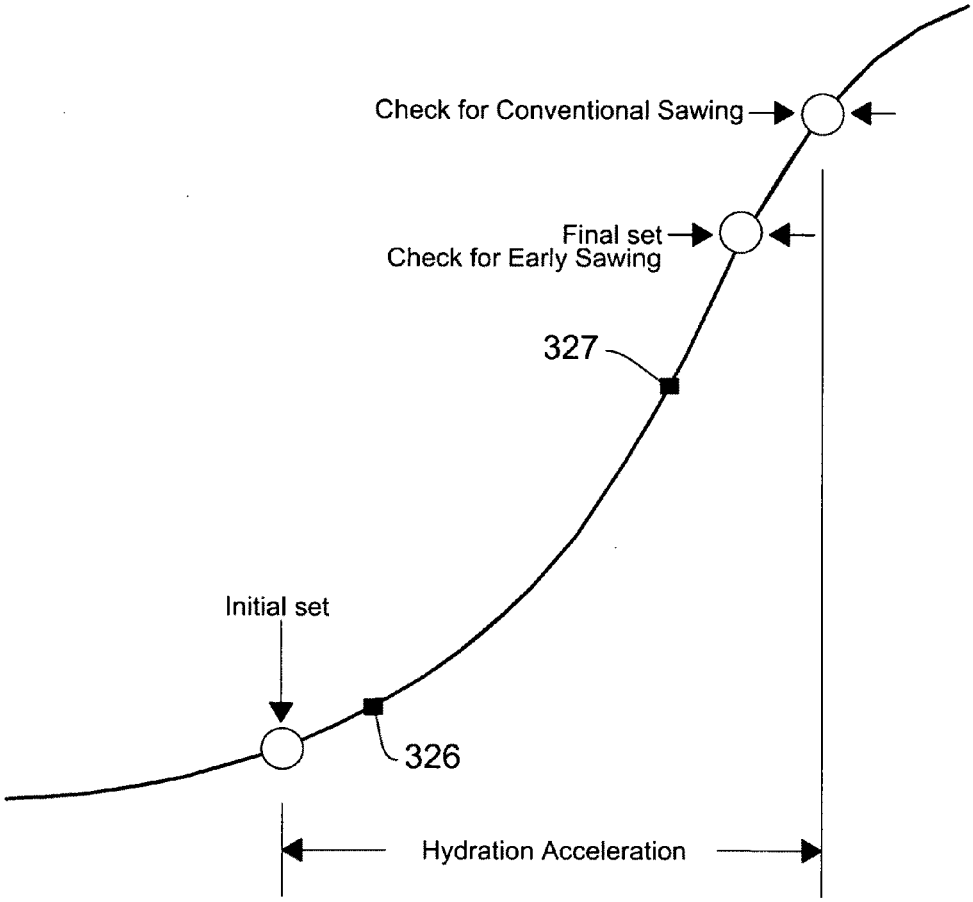
FIG. 18 is an enlarged portion of FIG. 1 showing approximate times to begin trowelling with pans and blades.

FIG. 18 is an enlarged view of FIG. 1 depicting the "hardening" stage of the hydration curve in which the approximate time for operating the riding trowel with pans 326 and as curing continues; the use of finish blades 327 is shown. It is well known that several factors contribute to the exact time panning and finishing are initiated, including local weather conditions (i.e. humidity, temperature, etc.) and mixture content of the concrete.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A motorized, hydraulic riding trowel for finishing concrete, said riding trowel comprising:

rotor means pivotally suspended from said riding trowel, said rotor means comprising a plurality of radially spaced apart blades for frictionally contacting the concrete;

manually operated control levers for tilting the rotor means to effectuate trowel steering, maneuvering, and propulsion;

hydraulic drive motor means for rotating said rotor means;

primary hydraulic pump means for supplying hydraulic flow pressure;

pump control head means for controlling said primary hydraulic pump means for supplying flow and pressure to said hydraulic drive motors;

a pump control head (PCH) control line for controlling said pump control head means;

user operated foot-pedal valve means for controlling said primary hydraulic pump means by pressuring said pump control head (PCH) line; and, unloader valve means for dynamically responding to varying friction and load fluctuations encountered in trowel use and generating an unloader pressure signal (UPS), the unloader valve means comprising:

unloader pressure signal means for sensing output pressure from said primary hydraulic pump means and deriving said unloader pressure signal (UPS) when an optimum set point pressure condition occurs; and, pressure control head means for normally conducting fluid from said foot-pedal valve means to said pump control head (PCH) control line and for interrupting normal fluid flow from said foot-pedal valve means to said pump control head (PCH) line in response to said unloader pressure signal (UPS).

2. The trowel as defined in claim 1 wherein said unloader valve means comprises a shuttle valve for sensing pressure output by said hydraulic pump means, and a sequence valve responsive to said shuttle valve for generating said unloader pressure signal (UPS) when an optimum set point pressure condition occurs.

3. The trowel as defined in claim 1 wherein said pump control head (PCH) control valve means comprises diverter valve means for normally establishing an unobstructed fluid flow path from said foot pedal valve means to said pump control head (PCH) line and for providing an increased resistance path from said foot pedal valve means to said pump control head (PCH) line in response to said unloader pressure signal (UPS).

4. The trowel as defined in claim 3 wherein said pump control head (PCH) control valve means comprises pressure reduction valve means for establishing said increased resistance path from said foot pedal valve means to said pump control head (PCH) line in response to said diverter valve means.

5. The trowel as defined in claim 4 further comprising blade pitch control means for varying rotor blade pitch.

6. The trowel as defined in claim 5 wherein said blade pitch control mean comprises hydraulic actuation means, and said trowel comprises auxiliary pump means for supplying pressure and flow to said blade pitch hydraulic actuation means and said foot pedal valve means.

7. The trowel as defined in claim 5 wherein:

said unloader valve means comprises a shuttle valve for sensing pressure applied to said hydraulic motor means, and a sequence valve responsive to said shuttle valve for generating said unloader pressure signal (UPS) when an optimum set point pressure condition occurs; and, said pump control head (PCH) control valve means comprises diverter valve means for normally establishing an unobstructed fluid flow path from said foot pedal valve means to said pump control head (PCH) line and for providing an increased resistance path from said foot pedal valve means to said pump control head (PCH) line in response to said unloader pressure signal (UPS).

8. The trowel as defined in claim 7 wherein said pump control head (PCH) control valve means comprises pressure reduction valve means for establishing said increased resistance path from said foot pedal valve means to said pump control head (PCH) line in response to said diverter valve means.

9. A motorized, hydraulic riding trowel for finishing concrete, said riding trowel comprising:

a pair of rotors pivotally suspended from said riding trowel, said rotors comprising a plurality of radially spaced apart blades for frictionally contacting the concrete;

steering means for tilting the rotors to effectuate trowel steering and maneuvering;

means accessible to a trowel operator for selectively activating said steering means, whereby the operator of the trowel can steer and control the riding trowel hydraulically;

hydraulic drive motors on each rotor for rotating said rotors;

gearbox means for speed reduction disposed between said drive motors and said rotors primary hydraulic pump means for supplying hydraulic pressure to said rotors;

a pump control head associated with said primary hydraulic pump means for controlling said drive motors;

a pump control head (PCH) control line connected to said pump control heads;

foot-pedal valve means for controlling said primary hydraulic pumps by pressuring said pump control head (PCH) line; and, unloader valve means for dynamically responding to varying friction and load fluctuations encountered in trowel use, the unloader valve means comprising: unloader pressure signal (UPS) circuit means for sensing output pressure on each primary hydraulic pump and deriving a unloader pressure signal (UPS) when an overpressure condition occurs; and, Pressure Control Head means for normally conducting fluid from said foot-pedal valve means to said pump control head (PCH) control line and for interrupting normal fluid flow from said foot-pedal valve means to said pump control head (PCH) line in response to said unloader pressure signal (UPS).

10. The trowel as defined in claim 9 wherein said unloader pressure signal (UPS) circuit means comprises a shuttle valve for sensing pressure output by both rotor motor pumps, and a sequencer valve for outputting said unloader pressure signal (UPS) in response to said shuttle valve when an optimum set point pressure condition occurs.

11. The trowel as defined in claim 10 wherein said pump control head (PCH) control valve means comprises diverter valve means for normally establishing an unobstructed fluid flow path from said foot pedal valve means to said pump control head (PCH) line and for providing an increased resistance path from said foot pedal valve means to said PCH line in response to said unloader pressure signal (UPS).

12. The trowel as defined in claim 11 wherein said pressure control head pump control head (PCH) control valve means comprises pressure reduction valve means for establishing said increased resistance path from said foot pedal valve means to said pump control head (PCH) line in response to said diverter valve means.

13. The trowel as defined in claim 12 wherein said primary hydraulic pump means is selected from the group consisting of:

Separate hydraulic pumps for each rotor; and

A single hydraulic pump and a splitter to divert hydraulic flow to each rotor.

14. A motorized, hydraulic riding trowel for finishing concrete, said riding trowel comprising:

a pair of rotors pivotally suspended from said riding trowel, said rotors comprising a plurality of radially spaced apart blades for frictionally contacting the concrete;

manually operated control levers for tilting the rotors to effectuate trowel steering and maneuvering;

means accessible to a trowel operator for selectively activating said steering means, whereby the operator of the trowel can steer and control the riding trowel hydraulically;

hydraulic drive motors on each rotor for rotating said rotors, the hydraulic drive motors selected from the group consisting of piston type hydraulic motors and gear and vane type motors;

a primary hydraulic pump for each rotor drive motor for supplying hydraulic pressure to said drive motors;

a pump control head on each primary hydraulic pump for controlling said drive motors;

a pump control head (PCH) control line connected to said pump control heads;

foot-pedal valve means for controlling said primary hydraulic pumps by pressuring said pump control head (PCH) line; and, unloader valve means for dynamically responding to varying friction and load fluctuations encountered in trowel use, the unloader valve means comprising: unloader pressure signal (UPS) circuit means for sensing output pressure on each primary hydraulic pump and deriving a unloader pressure signal (UPS) when an overpressure condition occurs; and, Pressure Control Head means for normally conducting fluid from said foot-pedal valve means to said pump control head (PCH) control line and for interrupting normal fluid flow from said foot-pedal valve means to said pump control head (PCH) line in response to said unloader pressure signal (UPS).

15. The trowel as defined in claims 14 further comprising gearbox means for speed reduction disposed between said drive motors and said rotors.

16. The trowel as defined in claim 14 wherein said unloader pressure signal (UPS) circuit means comprises a shuttle valve for sensing pressure output by both rotor motor pumps, and a sequencer valve for outputting said unloader pressure signal (UPS) in response to said shuttle valve when an optimum set point pressure condition occurs.

17. The trowel as defined in claim 16 wherein said pump control head (PCH) control valve means comprises diverter valve means for normally establishing an unobstructed fluid flow path from said foot pedal valve means to said pump control head (PCH) line and for providing an increased resistance path from said foot pedal valve means to said pump control head (PCH) line in response to said unloader pressure signal (UPS).

18. The trowel as defined in claim 17 wherein said pressure control head pump control head (PCH) control valve means comprises pressure reduction valve means for establishing said increased resistance path from said foot pedal valve means to said pump control head (PCH) line in response to said diverter valve means.

19. The trowel as defined in claims 18 further comprising gearbox means for speed reduction disposed between said drive motors and said rotors.

* * * * *